US008704169B2

(12) United States Patent
Alusta et al.

(10) Patent No.: US 8,704,169 B2
(45) Date of Patent: Apr. 22, 2014

(54) DIRECT IMPACT IONIZATION (DII) MASS SPECTROMETRY

(75) Inventors: Pierre Alusta, Little Rock, AR (US); Cameron Dorey, Pittsburgh, PA (US); William Ryan Parker, Greers Ferry, AR (US); Jon G. Wilkes, Little Rock, AR (US); Dan Buzatu, Benton, AR (US)

(73) Assignee: The United States of America, as represented by the Secretary, Department of Health and Human Services, Washington, DC (US)

( * ) Notice: Subject to any disclaimer, the term of this patent is extended or adjusted under 35 U.S.C. 154(b) by 0 days.

(21) Appl. No.: 13/271,182

(22) Filed: Oct. 11, 2011

(65) Prior Publication Data

US 2013/0087700 A1 Apr. 11, 2013

(51) Int. Cl.
*H01J 49/04* (2006.01)
*H01J 49/12* (2006.01)

(52) U.S. Cl.
USPC ..... 250/288; 250/282; 250/287

(58) Field of Classification Search
USPC ..... 250/281, 282, 286–288
See application file for complete search history.

(56) References Cited

U.S. PATENT DOCUMENTS

| | | | | |
|---|---|---|---|---|
| 3,852,595 | A * | 12/1974 | Aberth | 250/288 |
| 3,970,887 | A * | 7/1976 | Smith et al. | 313/309 |
| 4,408,125 | A | 10/1983 | Meuzelaar | |
| 4,926,056 | A * | 5/1990 | Spindt | 250/423 F |
| 5,948,610 | A | 9/1999 | Ho et al. | |
| 6,037,118 | A | 3/2000 | Thomas et al. | |
| 6,627,881 | B1 | 9/2003 | Bertrand et al. | |
| 6,996,472 | B2 | 2/2006 | Wilkes et al. | |
| 7,112,785 | B2 | 9/2006 | Laramee et al. | |
| 7,196,525 | B2 | 3/2007 | Sparkman et al. | |
| 7,977,629 | B2 | 7/2011 | McEwen et al. | |
| 8,242,459 | B2 | 8/2012 | Sun et al. | |

(Continued)

FOREIGN PATENT DOCUMENTS

| | | | |
|---|---|---|---|
| WO | WO2004/088271 | A2 | 10/2004 |
| WO | WO2004/112074 | A2 | 12/2004 |
| WO | WO2008/046111 | A2 | 4/2008 |
| WO | WO2010/085897 | A1 | 8/2010 |

OTHER PUBLICATIONS

JEOL AccuTOF™-DART™ (Direct Analysis in Real Time), http://www.jeolusa.com/PRODUCTS/AnalyticalInstruments/MassSpectrometers/AccuTOFDART/AccuTOFDARTTechnology/tabid/449/Default.aspx, downloaded Feb. 11, 2013.

(Continued)

*Primary Examiner* — Robert Kim
*Assistant Examiner* — David E Smith
(74) *Attorney, Agent, or Firm* — Klarquist Sparkman, LLP

(57) ABSTRACT

Disclosed is a mass spectrometer for analyzing a sample that has or is suspected of having microorganisms. The disclosed mass spectrometer has been uniquely configured to include a sample platform which functions as a counter electrode or discharge electrode and a surface to provide the sample to be analyzed. The mass spectrometer also includes an ion source positioned adjacent to the sample platform for ionizing and volatizing molecules within the sample, wherein the sample platform and the ion source are positioned such that during operation of the mass spectrometer an electrical discharge takes place between the ion source and the sample platform. Also disclosed are methods for generating a mass spectrum profile/fingerprint of a sample. The methods include positioning a sample platform having a sample adjacent to an ion source.

28 Claims, 17 Drawing Sheets

(56) References Cited

U.S. PATENT DOCUMENTS

| | | | | |
|---|---|---|---|---|
| 8,299,444 | B2 | 10/2012 | Ding et al. | |
| 8,338,780 | B2 | 12/2012 | Bai et al. | |
| 2006/0214102 | A1* | 9/2006 | Bai et al. | 250/288 |
| 2007/0023631 | A1* | 2/2007 | Takats et al. | 250/282 |
| 2008/0173809 | A1 | 7/2008 | Wu | |
| 2009/0238723 | A1* | 9/2009 | Guharay | 422/68.1 |
| 2010/0230589 | A1* | 9/2010 | Truche et al. | 250/283 |
| 2011/0108726 | A1* | 5/2011 | Hiraoka et al. | 250/282 |
| 2011/0121173 | A1* | 5/2011 | Koenig et al. | 250/282 |
| 2012/0286155 | A1 | 11/2012 | Mulligan | |

OTHER PUBLICATIONS

Alusta et al., "Direct Impact Corona Ionization of Bacteria for Rapid, Reproducible Identification via Spectral Pattern Recognition," American Institute of Physics, 1326:128-134, (2011).

* cited by examiner

DIRECT IMPACT IONIZATION (DII) MASS SPECTROMETRY

FIELD OF THE DISCLOSURE

This disclosure relates to the field of spectral analysis of biological samples and specifically to the analysis of biological samples by mass spectrometry.

BACKGROUND

Mass spectrometry comprises a broad range of instruments and methodologies that are used to elucidate the structural and chemical properties of molecules, to identify the compounds present in physical and biological matter, and to quantify the chemical substances found in samples of such matter.

Mass spectrometers measure the masses of individual molecules that have been converted to gas-phase ions, i.e., to electrically charged molecules in a gaseous state. The principal parts of a typical mass spectrometer are the ion source, mass analyzer, detector, and data handling system. In practice, solid, liquid, or vapor samples are introduced into the ion source where ionization and volatilization occur. To effect ionization, it is necessary to transfer some form of energy to the sample molecules. In most instances, this causes some of the nascent molecular ions to disintegrate into a variety of fragment ions. Both surviving molecular ions and fragment ions formed in the ion source are passed onto the mass analyzer, which uses electromagnetic forces to sort them according to their mass-to-charge ratios (m/z), or a related mechanical property, such as velocity, momentum, or energy. After they are separated by the analyzer, the ions are successively directed to the detector. The detector generates electrical signals, the magnitudes of which are proportional to the number of ions striking the detector per unit time. The data system records these electrical signals and displays them on a monitor or prints them out in the form of a mass spectrum, for example as a graph of signal intensity versus m/z. In principle, the pattern of molecular-ion and fragment-ion signals that appear in the mass spectrum of a sample, such as microorganism sample, constitutes a unique chemical fingerprint from which the sample's constituents can be deduced. The identification of microorganisms based upon their spectroscopic, spectrometric, and chromatographic characteristics would represent a useful method for the identification of microorganisms such as yeast, fungi, protozoa, and bacteria, including pathogenic organisms.

Since the discovery of typing whole cell bacteria by mass spectrometry (see e.g. Meuzelaar and Kistemaker, *Anal. Chem.* 45 (3): 587-590, 1973; and Meuzelaar et al., *Biol. Mass Spectrometry,* 1 (5): 312-319, 1973), numerous attempts have been made to automate the typing process, most recently using either pyrolysis mass spectrometry (PyMS) (Gutteridge and Schweppes, *Meth. Microbiology,* 19. ISBN 0-12-521519 3, Academic Press Limited, UK, 1987, Freeman et al., 1990, and Fenselau and Demirev, *J. Med. Microbiol.* 32, 283-286, 2002) or matrix-assisted laser desorption/ionization time-of flight mass spectrometry (MALDI TOF) (see e.g. Bright et al., *J. Microbiol. Methods,* 48 (2-3): 127-138, 2002; William et al., *J. Am. Soc. Mass. Spectrom.* 14 (4): 342-351, 2003; Keysa et al., *Inf., Gen. and Evol.* 4 (3): 221-242, 2004). However generating reproducible mass spectra from bacterial samples in a timely fashion at atmospheric pressure has remained problematic for many years. Furthermore, rapid pathogen identification to the subspecies level from bacteria to form a library of reproducible mass spectra has not been achieved, despite several attempts at various approaches (see e.g. Goodacre and Kell, *Current Opin. in Biotechnol.,* 7, 1: 20-28, 1996; and Fenselau and Demirev, *Mass Spectrometry Rev.,* 20, 4: 157-171, 2001). Thus, there is a need for new methods and devices that enable the pathogen identification using mass spectrometric analysis.

SUMMARY OF THE DISCLOSURE

Disclosed is a mass spectrometer for analyzing a sample that has or is suspected of having microorganisms. The disclosed mass spectrometer has been uniquely configured to include a sample platform which functions as a counter electrode or discharge electrode and a surface to provide the sample to be analyzed. The mass spectrometer also includes an ion source positioned adjacent to the sample platform for ionizing and volatizing molecules within the sample, wherein the sample platform and the ion source are positioned such that during operation of the mass spectrometer an electrical discharge takes place between the ion source and the sample platform. In some embodiments, the ionized and volatized molecules are taken in and collected by an ion transmission device adjacent to the ion source during operation of the mass spectrometer and a time of flight mass analyzer coupled to the ion transmission device is used for measuring a mass to charge ratio (m/z) of the molecules collected in the ion transmission device, thereby allowing a mass spectrum profile/fingerprint of the sample to be generated.

Also disclosed are methods for generating a mass spectrum profile/fingerprint of a sample. The methods include positioning a sample platform having a sample adjacent to an ion source. The sample is excited with an electrical discharge between the ion source and the sample platform, wherein the electrical discharge is sufficient to ionize and volatize biological molecules within the sample. The ionized and volatized molecules are collected within an ion transmission device and the m/z ratio is measured with a time of flight mass analyzer, thereby allowing a mass spectrum profile/fingerprint to be generated.

The foregoing and advantages of the present disclosure will become more apparent from the following detailed description of a several embodiments which proceeds with reference to the accompanying figures.

BRIEF DESCRIPTION OF THE FIGURES

FIG. 14A is a mass spectrum obtained from the highest point of the 560.5 m/z single ion pyrogram (see asterisk in lower left curve in FIG. 13). The mass spectrum shown in FIG. 14A is virtually identically to the one shown in FIG. 14B (obtained from the highest point of the 560.5 m/z single ion pyrogram (see asterisk in lower right curve in FIG. 13) under the same conditions).

DETAILED DESCRIPTION

I. Listing of Terms

Figure 1:
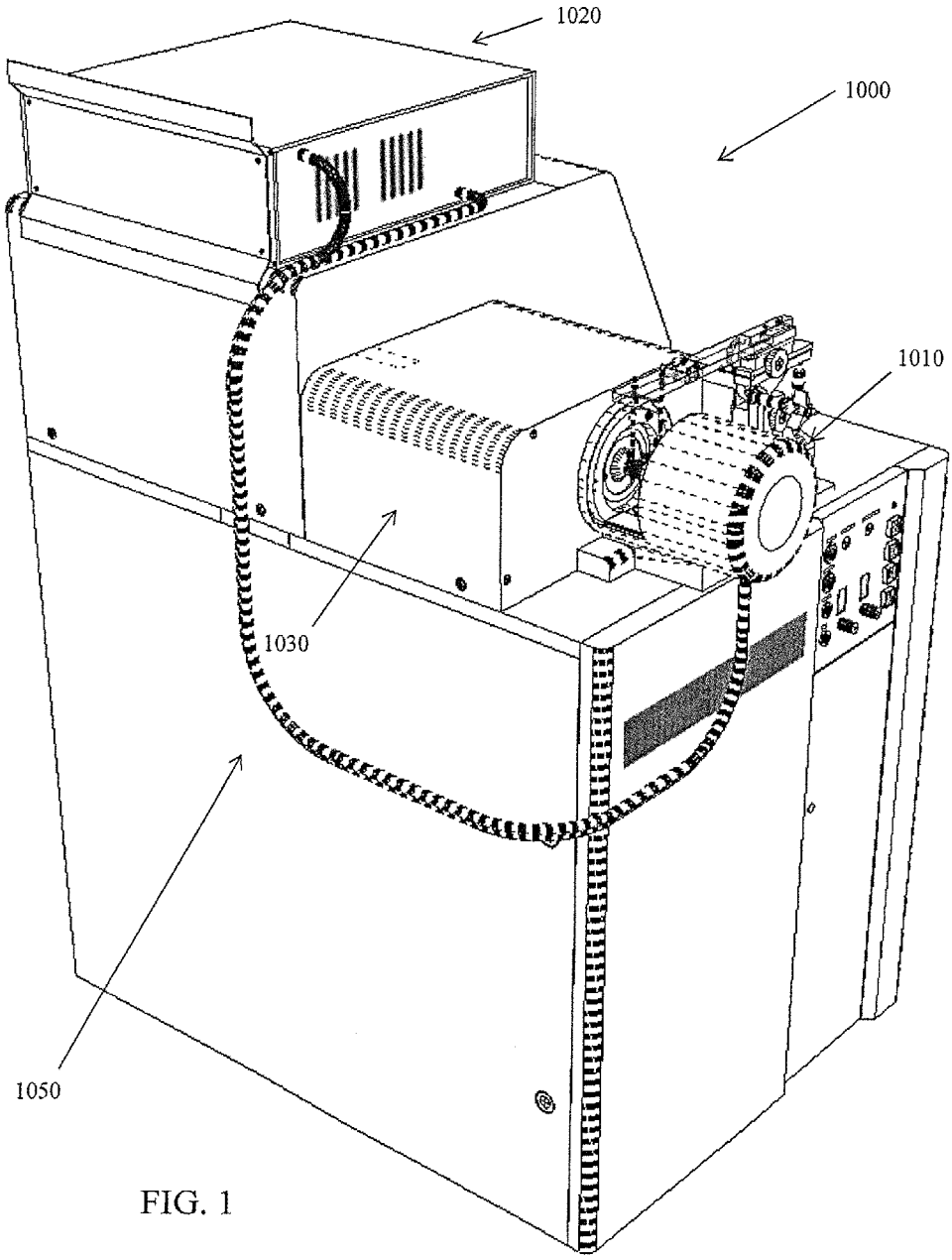
FIG. 1 is a diagram of an exemplary mass spectrometer, configured for direct impact ionization.

Unless otherwise noted, technical terms are used according to conventional usage. Definitions of common terms in molecular biology may be found in Benjamin Lewin, Genes IX, published by Jones and Bartlet, 2008 (ISBN 0763752223); Kendrew et al. (eds.), The Encyclopedia of Molecular Biology, published by Blackwell Science Ltd., 1994 (ISBN 0632021829); and Robert A. Meyers (ed.), Molecular Biology and Biotechnology: a Comprehensive Desk Reference, published by VCH Publishers, Inc., 1995 (ISBN 9780471185710).

The singular terms "a," "an," and "the" include plural referents unless context clearly indicates otherwise. Similarly, the word "or" is intended to include "and" unless the context clearly indicates otherwise. The term "comprises" means "includes." In case of conflict, the present specification, including explanations of terms, will control.

To facilitate review of the various embodiments of this disclosure, the following explanations of terms are provided:

Bacterial pathogen: A bacteria that causes disease (pathogenic bacteria). Examples of pathogenic bacteria include without limitation any one or more of (or any combination of) *Acinetobacter baumanii, Actinobacillus* sp., *Actinomycetes, Actinomyces* sp. (such as *Actinomyces israelii* and *Actinomyces naeslundii*), *Aeromonas* sp. (such as *Aeromonas hydrophila, Aeromonas veronii* biovar sobria (*Aeromonas sobria*), and *Aeromonas caviae*), *Anaplasma phagocytophilum, Anaplasma marginale, Alcaligenes xylosoxidans, Acinetobacter baumanii, Actinobacillus actinomycetemcomitans, Bacillus* sp. (such as *Bacillus anthracis, Bacillus cereus, Bacillus subtilis, Bacillus thuringiensis*, and *Bacillus stearothermophilus*), *Bacteroides* sp. (such as *Bacteroides fragilis*), *Bartonella* sp. (such as *Bartonella bacilliformis* and *Bartonella henselae, Bifidobacterium* sp., *Bordetella* sp. (such as *Bordetella pertussis, Bordetella parapertussis*, and *Bordetella bronchiseptica*), *Borrelia* sp. (such as *Borrelia recurrentis*, and *Borrelia burgdorferi*), *Brucella* sp. (such as *Brucella abortus, Brucella canis, Brucella melintensis* and *Brucella suis*), *Burkholderia* sp. (such as *Burkholderia pseudomallei* and *Burkholderia cepacia*), *Campylobacter* sp. (such as *Campylobacter jejuni, Campylobacter coli, Campylobacter lari* and *Campylobacter fetus*), *Capnocytophaga* sp., *Cardiobacterium hominis, Chlamydia trachomatis, Chlamydophila pneumoniae, Chlamydophila psittaci, Citrobacter* sp. *Coxiella bumetii, Corynebacterium* sp. (such as, *Corynebacterium diphtheriae, Corynebacterium jeikeum* and *Corynebacterium*), *Clostridium* sp. (such as *Clostridium perfringens, Clostridium difficile, Clostridium botulinum* and *Clostridium tetani*), *Eikenella corrodens, Enterobacter* sp. (such as *Enterobacter aerogenes, Enterobacter agglomerans, Enterobacter cloacae* and *Escherichia coli*, including opportunistic *Escherichia coli*, such as enterotoxigenic *E. coli*, enteroinvasive *E. coli*, enteropathogenic *E. coli*, enterohemorrhagic *E. coli*, enteroaggregative *E. Coli* and uropathogenic *E. coli*) *Enterococcus* sp. (such as *Enterococcus faecalis* and *Enterococcus faecium*)*Ehrlichia* sp. (such as *Ehrlichia chafeensia* and *Ehrlichia canis*), *Erysipelothrix rhusiopathiae, Eubacterium* sp., *Francisella tularensis, Fusobacterium nucleatum, Gardnerella vaginalis, Gemella morbillorum, Haemophilus* sp. (such as *Haemophilus influenzae, Haemophilus ducreyi, Haemophilus aegyptius, Haemophilus parainfluenzae, Haemophilus haemolyticus* and *Haemophilus parahaemolyticus, Helicobacter* sp. (such as *Helicobacter pylori, Helicobacter cinaedi* and *Helicobacter fennelliae*), *Kingella kingii, Klebsiella* sp. (such as *Klebsiella pneumoniae, Klebsiella granulomatis* and *Klebsiella oxytoca*), *Lactobacillus* sp., *Listeria monocytogenes, Leptospira interrogans, Legionella pneumophila, Leptospira interrogans, Peptostreptococcus* sp., *Mannheimia hemolytica, Moraxella catarrhalis, Morganella* sp., *Mobiluncus* sp., *Micrococcus* sp., *Mycobacterium* sp. (such as *Mycobacterium leprae, Mycobacterium tuberculosis, Mycobacterium paratuberculosis, Mycobacterium intracellulare, Mycobacterium avium, Mycobacterium bovis*, and *Mycobacterium marinum*), *Mycoplasm* sp. (such as *Mycoplasma pneumoniae, Mycoplasma hominis*, and *Mycoplasma genitalium*), *Nocardia* sp. (such as *Nocardia asteroides, Nocardia cyriacigeorgica* and *Nocardia brasiliensis*), *Neisseria* sp. (such as *Neisseria gonorrhoeae* and *Neisseria meningitidis*), *Pasteurella multocida, Plesiomonas shigelloides. Prevotella* sp., *Porphyromonas* sp., *Prevotella melaninogenica, Proteus* sp. (such as *Proteus vulgaris* and *Proteus mirabilis*), *Providencia* sp. (such as *Providencia alcalifaciens, Providencia rettgeri* and *Providencia stuartii*), *Pseudomonas aeruginosa, Propionibacterium acnes, Rhodococcus equi, Rickettsia* sp. (such as *Rickettsia rickettsii, Rickettsia akari* and *Rickettsia prowazekii, Orientia tsutsugamushi* (formerly: *Rickettsia tsutsugamushi*) and *Rickettsia typhi*), *Rhodococcus* sp., *Serratia marcescens, Stenotrophomonas maltophilia, Salmonella* sp. (such as *Salmonella enterica, Salmonella typhi, Salmonella paratyphi, Salmonella enteritidis, Salmonella cholerasuis* and *Salmonella typhimurium*), *Serratia* sp. (such as *Serratia marcesans* and *Serratia liquifaciens*), *Shigella* sp. (such as *Shigella dysenteriae, Shigella flexneri, Shigella boydii* and *Shigella sonnei*), *Staphylococcus* sp. (such as *Staphylococcus aureus, Staphy-*

*lococcus epidermidis, Staphylococcus hemolyticus, Staphylococcus saprophyticus*), *Streptococcus* sp. (such as *Streptococcus pneumoniae* (for example chloramphenicol-resistant serotype 4 *Streptococcus pneumoniae*, spectinomycin-resistant serotype 6B *Streptococcus pneumoniae*, streptomycin-resistant serotype 9V *Streptococcus pneumoniae*, erythromycin-resistant serotype 14 *Streptococcus pneumoniae*, optochin-resistant serotype 14 *Streptococcus pneumoniae*, rifampicin-resistant serotype 18C *Streptococcus pneumoniae*, tetracycline-resistant serotype 19F *Streptococcus pneumoniae*, penicillin-resistant serotype 19F *Streptococcus pneumoniae*, and trimethoprim-resistant serotype 23F *Streptococcus pneumoniae*, chloramphenicol-resistant serotype 4 *Streptococcus pneumoniae*, spectinomycin-resistant serotype 6B *Streptococcus pneumoniae*, streptomycin-resistant serotype 9V *Streptococcus pneumoniae*, optochin-resistant serotype 14 *Streptococcus pneumoniae*, rifampicin-resistant serotype 18C *Streptococcus pneumoniae*, penicillin-resistant serotype 19F *Streptococcus pneumoniae*, or trimethoprim-resistant serotype 23F *Streptococcus pneumoniae*), *Streptococcus agalactiae, Streptococcus mutans, Streptococcus pyogenes*, Group A streptococci, *Streptococcus pyogenes*, Group B streptococci, *Streptococcus agalactiae*, Group C streptococci, *Streptococcus anginosus, Streptococcus equismilis*, Group D streptococci, *Streptococcus bovis*, Group F streptococci, and *Streptococcus anginosus* Group G streptococci), *Spirillum minus, Streptobacillus moniliformi, Treponema* sp. (such as *Treponema carateum, Treponema petenue, Treponema pallidum* and *Treponema endemicum, Tropheryma whippelii, Ureaplasma urealyticum, Veillonella* sp., *Vibrio* sp. (such as *Vibrio cholerae, Vibrio parahemolyticus, Vibrio vulnificus, Vibrio parahaemolyticus, Vibrio vulnificus, Vibrio alginolyticus, Vibrio mimicus, Vibrio hollisae, Vibrio fluvialis, Vibrio metchnikovii, Vibrio damsela* and *Vibrio furnisii*), *Yersinia* sp. such as *Yersinia enterocolitica, Yersinia pestis*, and *Yersinia pseudotuberculosis*) and *Xanthomonas maltophilia* among others. In some embodiments, one or more of the pathogenic bacteria listed above is detected using the methods and devices disclosed herein. In some embodiments, representative spectra of one of more of the pathogenic bacteria listed above is stored in a database.

Brush Discharge: In between a corona discharge and a spark discharge is a brush discharge, which may take place, for example, between a charged material and a normally grounded electrode. If a brush discharge is maintained over longer periods, it may appear as irregular luminescent paths.

Classification parameters: Classification parameters include, for example, gram staining (e.g., gram positive or negative) and morphology (rods or cocci) or oxygen requirements (e.g., aerobic or anaerobic) or other physiological characteristics (such as ability to reduce sulfate). Further examples of classification parameters may be found in Bergey's Manual of Determinative Bacteriology, 9th ed., Williams and Wilkins, Baltimore, Md., 1994, Food Microbiology: Fundamentals and Frontiers, Doyle et al., eds., ASM Press, Washington, D.C., 1997, and Zinsser Microbiology, 19th ed., Joklik et al., eds., Appleton & Lange, Norwalk, Conn., 1988, all of which are incorporated by reference herein.

Biomolecule: Any molecule that was derived from a biological system, including, but not limited to, a synthetic or naturally occurring protein, glycoprotein, lipoprotein, amino acid, nucleoside, nucleotide, nucleic acid, oligonucleotide, DNA, RNA, carbohydrate, sugar, lipid, fatty acid, hapten, and the like. In some examples, a biomolecule is a target analyte for which the presence and or concentration or amount can be determined, for example to determine the presence of a microorganism that produces or whose presence is otherwise correlated to the presence of the biomolecule.

Control: A reference standard. In some examples, a control can be a known value indicative of a known concentration or amount of an analyte, such as a target analyte for example a biomolecule or microorganism of interest. In some examples, a control, or a set of controls of known concentration or amount can be used to calibrate a mass spectrometer. In some examples, a control is zero concentration of an analyte.

Corona: A current that develops from an electrode with a high potential in a neutral fluid, such as an inert gas, by ionizing that fluid so as to create a plasma around the electrode. The ions generated eventually pass charge to nearby areas of lower potential, such as a counter electrode. When the potential gradient is large enough at a point in the fluid, the fluid at that point ionizes and becomes conductive. Corona discharge usually involves two electrodes.

Corona Discharge: If the field strength in front of a sharp point of a conductor exceeds the breakdown field strength for the medium (for example, an inert gas), a corona discharge will take place.

Descriptor Peak: A high mass ion that appears in a global mass spectrum of a microorganism sample.

Detect: To determine if an agent (such as a signal or target analyte) is present or absent. In some examples, this can further include quantification. In some examples, a mass signal is used to detect the presence, amount or concentration of an agent, such as an analyte, for example a microorganism.

Direct Impact Ionization: A technique used to ionize and volatilize a sample for mass spectrometric analysis. During direct impact ionization, an electrical discharge directly impacts the sample.

Electrical Discharge: A discharge happens if the field from a charge is high enough to cause ionization in the surrounding medium. In an electrical discharge process, the charge carriers are created by the field. Electrical discharges occur in three sometimes-overlapping groups: corona, spark, and brush discharges.

Electromagnetic radiation: A series of electromagnetic waves that are propagated by simultaneous periodic variations of electric and magnetic field intensity, and that includes radio waves, infrared, visible light, ultraviolet light, X-rays and gamma rays. In particular examples, electromagnetic radiation is in the form of electrons, which can discharge from an ion source to a counter or discharge electrode.

Fingerprint spectra (spectrum): Spectra (a spectrum) of microorganisms or their chemical constituents that may serve as the basis for distinguishing, identifying or detecting microorganisms of different taxonomic groups. Physiologically similar groups (e.g., facultatively anaerobic gram negative rods; see, for example, Bergey's Manual of Determinative Bacteriology, 9th ed., Williams and Wilkins, Baltimore, Md., 1994), families, genera, species, strains, or sub-strains of microorganisms are examples of such taxonomic groups. Examples of fingerprint spectra include mass spectra, such as those obtained by the methods or using the devices disclosed herein. Fingerprint spectra also include any combination of fingerprint spectra obtained from the techniques listed herein. Fingerprint spectra may also be portions or subsets of fingerprint spectra.

Fungal pathogen: A fungus that causes disease. Examples of fungal pathogens include without limitation *Trichophyton rubrum, T. mentagrophytes, Epidermophyton floccosum, Microsporum canis, Pityrosporum orbiculare* (*Malassezia furfur*), *Candida* sp. (such as *Candida albicans*), *Aspergillus* sp. (such as *Aspergillus fumigatus, Aspergillus flavus* and *Aspergillus clavatus*), *Cryptococcus* sp. (such as *Cryptococ-*

*cus neoformans, Cryptococcus gattii, Cryptococcus laurentii* and *Cryptococcus albidus*), *Histoplasma* sp. (such as *Histoplasma capsulatum*), *Pneumocystis* sp. (such as *Pneumocystis jirovecii*), and *Stachybotrys* (such as *Stachybotrys chartarum*) among others. In some embodiments, one or more of the fungal pathogens listed above is detected using the methods and devices disclosed herein. In some embodiments, representative spectra of one of more of the fungal pathogens listed above is stored in a data base.

High throughput technique: Through this process, one can rapidly identify analytes present in a sample or multiple samples. In certain examples, combining modern robotics, data processing and control software, liquid handling devices, and sensitive detectors, high throughput techniques allows the rapid detection and/or quantification of an analyte in a short period of time, for example using the assays and compositions disclosed herein.

Ion transmission device: A combination of electric or magnetic fields that moves ions into a mass analyzer. Examples of ion transmission devices include RF-only Qusadrapoles and RF-only Hexapoles.

Library Database: A database of fingerprint spectra that are obtained from microorganisms.

Microorganism: A microscopic organism, including bacteria (e.g. gram positive and gram negative cocci and gram positive and gram negative bacilli, mycoplasmas, rickettsias, actinomycetes, and archaeobacteria), fungi (fungi, yeast, molds), and protozoa (amoebae, flagellates, ciliates, and sporozoa). While viruses (naked viruses and enveloped viruses) are not minute "living" organisms as typically ascribed to the term microorganism, for purposes of this disclosure they are included in the term microorganism because of their effect on biological systems. The term microorganism also encompasses quiescent forms of microscopic organisms such as spores (endospores). Certain microorganisms are pathogens.

Metabolically Similar: As applied to microorganisms, two microorganisms are metabolically similar if they respond to their environment by producing similar sets of biomolecules. Metabolically similar microorganisms will, in some embodiments, belong to a single class of physiologically similar microorganisms (e.g.,—facultatively anaerobic gram negative rods or dissimilatory sulfate-reducing bacteria; see, for example, Bergey's Manual of Determinative Bacteriology, 9th ed., Williams and Wilkins, Baltimore, Md., 1994, Food Microbiology: Fundamentals and Frontiers, Doyle et al., eds., ASM Press, Washington, D.C., 1997, or Zinsser Microbiology, 19th ed., Joklik et al., eds., Appleton & Lange, Norwalk, Conn., 1988 for groupings of microorganisms according to their physiological characteristics). Fungi including yeast are characteristically similar if they have similar morphology, ultrastructure, cell wall composition, carbohydrate biochemistry, and polysaccharide biosynthesis. Protozoa, which are identified by their morphological characteristics may be further distinguished by their usual locations. In other embodiments, metabolically similar microorganisms are microorganisms within the same taxonomic family (for example, Enterobacteriaceae), genus (for example, *Escherichia*), species (for example, *Escherichia coli*), strain (for example, *E. coli* 1090) or serotype (e.g. *E. coli* serotype O:150, a serotype that is particularly pathogenic). Metabolically similar microorganisms are, in other embodiments, organisms that exhibit similar fingerprint spectra that change similarly in response to changes in environment.

Mass Spectrometry (MS): A method of chemical analysis in which the substance is exposed, for example, to a beam of electrons which causes ionization to occur, either of the molecules or their fragments. The ions thus produced are accelerated and then passed through a mass analyzer that separates the ions according to their mass-to-charge ratio.

Metastable Atom Bombardment (MAB): A technique for ionizing analyte molecules for mass spectral analysis by impacting analyte molecules with metastable atoms in the gas phase. Metastable atoms are typically generated in a noble gas discharge plasma (for example, helium, neon, argon, krypton, and xenon discharge plasmas) although a molecular nitrogen, $N_2$, plasma has also been found useful in many applications.

Pathogen: A specific causative agent of disease, such as a bacterium, virus, fungus, or parasite.

Parasite: An organism that lives inside humans or other organisms acting as hosts (for the parasite). Parasites are dependent on their hosts for at least part of their life cycle. Parasites are harmful to humans because they consume needed food, eat away body tissues and cells, and eliminate toxic waste, which makes people sick. Examples of parasites for use in accordance with the disclosed methods include without limitation any one or more of (or any combination of) Malaria (*Plasmodium falciparum, P. vivax, P. malariae*), Schistosomes, Trypanosomes, *Leishmania*, Filarial nematodes, Trichomoniasis, Sarcosporidiasis, *Taenia* (*T. saginata, T. solium*), *Leishmania, Toxoplasma gondii*, Trichinelosis (*Trichinella spiralis*) or Coccidiosis (*Eimeria* species). In some embodiments, one or more of the parasites listed above is detected using the methods and devices disclosed herein. In some embodiments, representative spectra of one of more of the parasites listed above is stored in a data base.

Pyrolysis Mass Spectrometry (PyMS): A mass spectrometric technique in which samples are subjected to a controlled thermal degradation in an inert atmosphere or vacuum (pyrolysis). This converts the chemical constituents that make up the sample into low molecular weight volatile compounds. Pyrolysis mass spectrometry is a method that measures the masses and abundances of these volatile fragments.

Quantitating: Determining or measuring a quantity (such as a relative quantity) of a molecule or the activity of a molecule, such as the quantity of analyte, such as a microorganism present in a sample.

Sample: A material to be analyzed. In one embodiment, a sample is a biological sample. In another embodiment, a sample is an environmental sample, such as soil, sediment water, or air. Environmental samples can be obtained from an industrial source, such as a farm, waste stream, or water source. A biological sample is one that includes biological materials (such as nucleic acid and proteins). In some examples, a biological sample is obtained from an organism or a part thereof, such as an animal. In particular embodiments, the biological sample is obtained from an animal subject, such as a human subject. A biological sample can be any solid or fluid sample obtained from, excreted by or secreted by any living organism, including without limitation multicellular organisms (such as animals, including samples from a healthy or apparently healthy human subject or a human patient affected by a condition or disease to be diagnosed or investigated, such as cancer). For example, a biological sample can be a biological fluid obtained from, for example, blood, plasma, serum, urine, bile, ascites, saliva, cerebrospinal fluid, aqueous or vitreous humor, or any bodily secretion, a transudate, an exudate (for example, fluid obtained from an abscess or any other site of infection or inflammation), or fluid obtained from a joint (for example, a normal joint or a joint affected by disease, such as a rheumatoid arthritis, osteoarthritis, gout or septic arthritis). A biological sample can also be a sample obtained from any organ or tissue (including a biopsy or autopsy specimen, such as a tumor biopsy) or can include a cell (whether a primary cell or cultured cell) or medium conditioned by any cell, tissue or organ.

Spark Discharge: In contrast to the corona discharge, in a spark discharge the ionization takes place all the way between the two electrodes. If the electrodes are connected to a voltage supply, the discharge may turn into a continuous arc.

Thermal Mass: Equivalent to thermal capacitance or heat capacity, which is the ability of a body to store or absorb thermal energy. For example, a material or machine part, such as a sample platform, with low thermal mass does not store very much heat energy.

Time of Flight Mass Spectrometry (TOFMS): A method of mass spectrometry in which an ion's mass-to-charge ratio is determined via a time measurement. Ions are accelerated by an electric field of known strength. This acceleration results in an ion having the same kinetic energy as any other ion that has the same charge. The velocity of the ion depends on the mass-to-charge ratio. The time that it subsequently takes for the particle to reach a detector at a known distance is measured. This time will depend on the mass-to-charge ratio of the particle (heavier particles reach lower speeds). From this time and the known experimental parameters one can find the mass-to-charge ratio of the ion.

Virus: A microscopic infectious organism that reproduces inside living cells. A virus consists essentially of a core of nucleic acid surrounded by a protein coat, and has the ability to replicate only inside a living cell. "Viral replication" is the production of additional virus by the occurrence of at least one viral life cycle. A virus may subvert the host cells' normal functions, causing the cell to behave in a manner determined by the virus. For example, a viral infection may result in a cell producing a cytokine, or responding to a cytokine, when the uninfected cell does not normally do so. In some examples, a virus is a pathogen. Specific examples of viral pathogens include, without limitation; Arenaviruses (such as Guanarito virus, Lassa virus, Junin virus, Machupo virus and Sabia), Arteriviruses, Roniviruses, Astroviruses, Bunyaviruses (such as Crimean-Congo hemorrhagic fever virus and Hantavirus), Barnaviruses, Birnaviruses, Bornaviruses (such as Borna disease virus), Bromoviruses, Caliciviruses, Chrysoviruses, Coronaviruses (such as Coronavirus and SARS), Cystoviruses, Closteroviruses, Comoviruses, Dicistroviruses, Flaviruses (such as Yellow fever virus, West Nile virus, Hepatitis C virus, and Dengue fever virus), Filoviruses (such as Ebola virus and Marburg virus), Flexiviruses, Hepeviruses (such as Hepatitis E virus), human adenoviruses (such as human adenovirus A-F), human astroviruses, human BK polyomaviruses, human bocaviruses, human coronavirus (such as a human coronavirus HKU1, NL63, and OC43), human enteroviruses (such as human enterovirus A-D), human erythrovirus V9, human foamy viruses, human herpesviruses (such as human herpesvirus 1 (herpes simplex virus type 1), human herpesvirus 2 (herpes simplex virus type 2), human herpesvirus 3 (*Varicella zoster* virus), human herpesvirus 4 type 1 (Epstein-Barr virus type 1), human herpesvirus 4 type 2 (Epstein-Barr virus type 2), human herpesvirus 5 strain AD169, human herpesvirus 5 strain Merlin Strain, human herpesvirus 6A, human herpesvirus 6B, human herpesvirus 7, human herpesvirus 8 type M, human herpesvirus 8 type P and Human Cyotmegalovirus), human immunodeficiency viruses (HIV) (such as HIV 1 and HIV 2), human metapneumoviruses, human papillomaviruses (such as human papillomavirus-1, human papillomavirus-18, human papillomavirus-2, human papillomavirus-54, human papillomavirus-61, human papillomavirus-cand90, human papillomavirus RTRX7, human papillomavirus type 10, human papillomavirus type 101, human papillomavirus type 103, human papillomavirus type 107, human papillomavirus type 16, human papillomavirus type 24, human papillomavirus type 26, human papillomavirus type 32, human papillomavirus type 34, human papillomavirus type 4, human papillomavirus type 41, human papillomavirus type 48, human papillomavirus type 49, human papillomavirus type 5, human papillomavirus type 50, human papillomavirus type 53, human papillomavirus type 60, human papillomavirus type 63, human papillomavirus type 6b, human papillomavirus type 7, human papillomavirus type 71, human papillomavirus type 9, human papillomavirus type 92, and human papillomavirus type 96), human parainfluenza viruses (such as human parainfluenza virus 1-3), human parechoviruses, human parvoviruses (such as human parvovirus 4 and human parvovirus B19), human respiratory syncytial viruses, human rhinoviruses (such as human rhinovirus A and human rhinovirus B), human spumaretroviruses, human T-lymphotropic viruses (such as human T-lymphotropic virus 1 and human T-lymphotropic virus 2), Human polyoma viruses, Hypoviruses, Leviviruses, Luteoviruses, Lymphocytic choriomeningitis viruses (LCM), Marnaviruses, Narnaviruses, Nidovirales, Nodaviruses, Orthomyxoviruses (such as Influenza viruses), Partitiviruses, Paramyxoviruses (such as Measles virus and Mumps virus), Picornaviruses (such as Poliovirus, the common cold virus, and Hepatitis A virus), Potyviruses, Poxviruses (such as Variola and Cowpox), Sequiviruses, Reoviruses (such as Rotavirus), Rhabdoviruses (such as Rabies virus), Rhabdoviruses (such as Vesicular stomatitis virus, Tetraviruses, Togaviruses (such as Rubella virus and Ross River virus), Tombusviruses, Totiviruses, Tymoviruses, Noroviruses, bovine herpesviruses including Bovine Herpesvirus (BHV) and malignant catarrhal fever virus (MCFV), among others. In some embodiments, one or more of the viruses listed above is detected using the methods and devices disclosed herein. In some embodiments, representative spectra of one of more of the viruses listed above is stored in a data base.

Suitable methods and materials for the practice or testing of this disclosure are described below. Such methods and materials are illustrative only and are not intended to be limiting. Other methods and materials similar or equivalent to those described herein can be used. For example, conventional methods well known in the art to which a disclosed invention pertains are described in various general and more specific references. In addition, the materials, methods, and examples are illustrative only and not intended to be limiting.

II. Introduction

In an effort to evaluate samples containing microorganism in a reproducible way, the inventors had initially utilized a time of flight (TOF) direct analysis in real time (DART) mass spectrometer capable of running samples at atmospheric pressure. Although the convenient but simple manual sample introduction the mass spectrometer is suitable for qualitatively analyzing volatile organic compounds, it is unsuitable for analyzing microbiological samples (i.e. bacteria, spores, whole cells and the like) due to the low volatility of many biomolecules in them. The mass spectrometer was, therefore, re-engineered and equipped with a gear plate to ensure reproducible analyte introduction and a pyrolysis device.

Initially, pyrolysis was considered necessary for vaporizing low volatility components of microbiological analytes such as bacteria, a prerequisite for being ionized and introduced into the mass spectrometer. Pyrolysis, however, proved impractical with atmospheric pressure sampling in that the electrical cables would overheat, their insulation would start to melt and give off fumes, thus adding undesired contaminants to the microbiological analytes. Furthermore, pyrolysis required low voltage but high current to operate properly. This meant that the operator needed to be cautious during pyrolysis.

However, working in a darkened lab, the inventors of the subject technology serendipitously discovered direct impact ionization mass spectrometry while repositioning a stainless steel sample holding pin within close proximity to the ion source gun on the TOF-DART mass spectrometer (JEOL AccuTOF™-DART™ mass spectrometer). During this test, a spark discharge was observed between the ion source and the stainless steel pin. Examination of the spectrum obtained from the corona discharge event revealed that the peak intensity observed was increased 490-fold beyond what had been observed with the instrument operating in normal ionization mode. In addition, the information contained in the spectrum was far more detailed then had previously been observed with the instrument in normal ionization mode. This unexpected result obtained from the direct impact of the sample with electrical discharge greatly enhances the ability to use mass spectrometric analysis to detect and/or identify microorganisms present in the sample.

III. Overview of Several Embodiments

As disclosed herein, starting with a JEOL AccuTOF™-DART™ mass spectrometer (see U.S. Pat. No. 7,112,785 (issued Sep. 26, 2006) and U.S. Pat. No. 7,196,525 (issued Mar. 27, 2007) which are specifically incorporated by reference herein) available from JEOL, Tokyo, Japan, the inventors have designed a mass spectrometer that is configured with a power generator used for direct ionizing microbiological analytes in a controlled fashion. In addition, a small environmental contaminant shield, such as a glass cylinder, with two juxtaposing orifices on each side was designed to fit within the sample introduction chamber. Coupled with an inert gas flowing from the ion source the environmental contaminant shield had the effect of excluding oxygen from the sample, thus preventing oxidation of analytes, such as microbiological analytes. Likewise, ambient moisture was also kept out, thus ensuring proton transfer from water molecules would not contribute to irreproducible ionization of the analyte.

A. Mass Spectrometer

A novel atmospheric pressure ionization process and mass spectrometric analyzer for carrying out this process is disclosed herein. In this process, termed direct impact ionization (DII), an electrical discharge, for example, a corona, spark or arc, emanating from an ion source impinges onto the surface of an electrically conducting sample platform, acting as a counter electrode, carrying a thin film of dried analytical sample, such as a dried bacterial suspension. In some embodiments, the two electrodes, the ion source electrode and the sample platform, are immersed in hot inert gas flux, such as a gas flux formed from an inert gas, (such as a noble gas, for example, Helium, Argon, Neon, Krypton, or Xenon (Radon would not typically be used as it is radioactive)) flowing past them. An electric potential is applied between the ion source and the sample platform, which results in the formation of an arc between the ion source and the platform. At a potential of about 1.0 kV to about 4.0 kV an arc is formed when the distance between the ion source and the sample platform is less than about 1 cm. At a distance of about 4 mm, a corona discharge is formed. At other distances a spark discharge is formed. The heat and electric charge from this electric discharge both ionizes and volatilizes the sample. The volatilized molecules are then drawn into the mass spectrometric analyzer, such as a mass analyzer equipped with an ion transmission device and a time-of-flight (TOF) mass analyzer. In some examples, the ion source is an electrode, for example, a needle electrode, to which an electrical potential can be applied. The electrode may be a point, line, plane, or curved-shape electrode. A needle electrode is an example of a point electrode, and a trim blade is an example of a line electrode. Indeed, there may be multiple needles or other electrodes of the same polarity. The electrode may be either a cathode establishing a negative potential or an anode establishing a positive potential. In the electrical discharge, positive ions or electrons are formed.

Biomolecular ions as heavy as 790 m/z are generated. Mass spectral fingerprints of bacteria are obtained with a high degree of reproducibility by selecting the highest intensity of an "indicator ion", for example 560.5 m/z or another relatively heavy ion whose appearance signals efficient vaporization of low volatility components.

With reference to FIG. 1, which shows an exemplary embodiment of a mass spectrometer that is configured for direct impact ionization of samples containing microorganisms, mass spectrometer 1000 includes ion source 1010, connected to power supply 1020. This embodiment of mass spectrometer 1000 also include an ion transmission device 1030, which captures ions volatilized from a sample, and a time-of-flight (TOF) mass analyzer 1050, which is used to determine the mass of a particle/molecule by virtue of its mass to charge ratio. While the configuration shown includes a TOF mass analyzer coupled to an ion transmission device, any other mass analyzer configuration can be used as long as sample induction can be conducted at atmospheric pressure, for example when the sample is impacted with an electrical discharge in a system open to the atmosphere.

Figure 2:
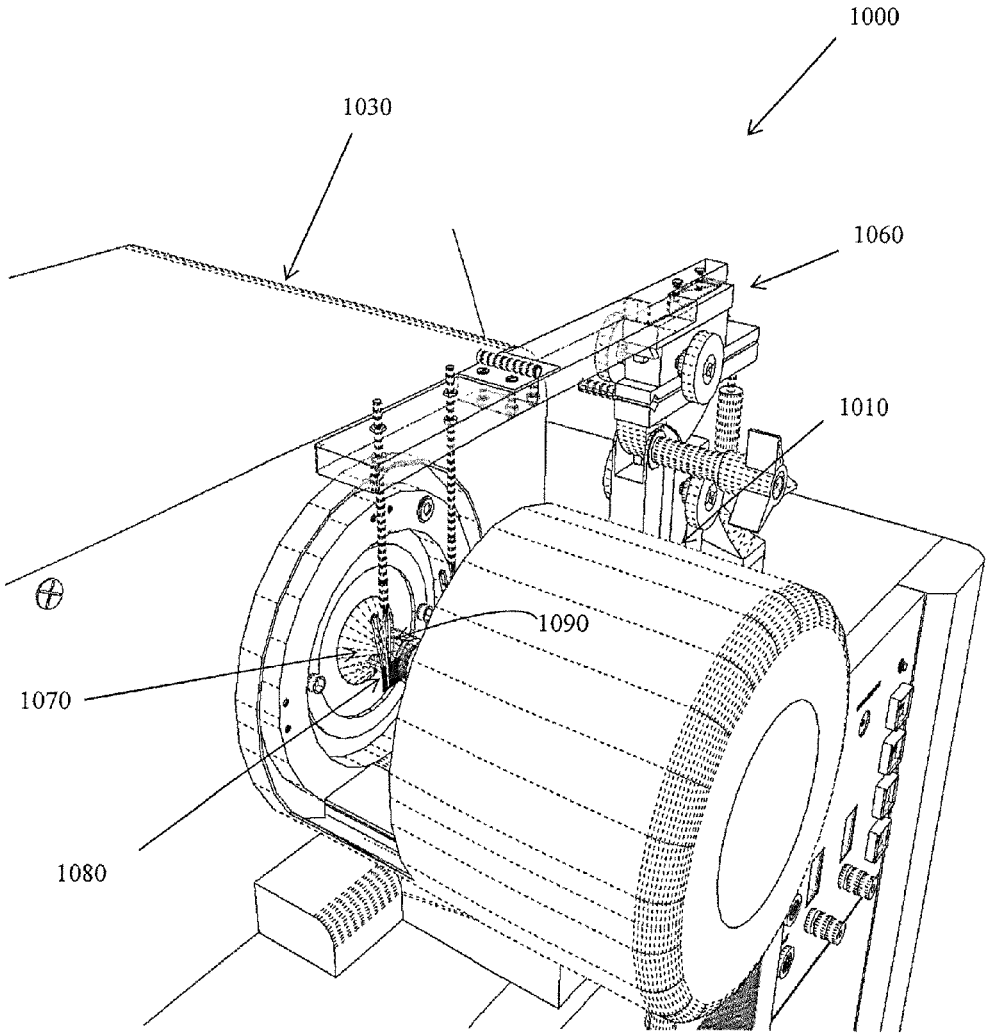
FIG. 2 is a diagram of the mass spectrometer shown in FIG. 1, detailing the configuration of the ion source and sample platform relative to the inlet of the ion transmission device.

FIG. 2 shows the details of a configuration of mass spectrometer 1000, shown in FIG. 1. With reference to FIG. 2, mass spectrometer 1000, includes ion source 1010, ion transmission device 1030 and sample positioning assembly 1060. Sample positioning assembly 1060 is used to reproducibly position samples between ion source 1010 and ion transmission device 1030, such that sample platform 1080 is positioned in close enough proximity to ion source 1010 that an electrical discharge is formed between ion source 1010 and sample platform 1080 during operation of mass spectrometer 1000. For a reproducible discharge, the potential needs to surpass air dielectric breakdown voltage which is a function of distance between electrodes. In some embodiments, the sample platform is positioned such that is about 1 centimeter (cm) or less from the ion source, such as less than about 10 millimeters (mm), less than about 9 mm, less than about 8 mm, less than about 7 mm, less than about 6 mm, less than about 5 mm, less than about 4 mm, less than about 3 mm, less than about 2 mm, less than about 1 mm, or less than about 0.50 mm from the ion source, for example between about 0.2 mm and about 10 mm, between about 0.4 mm and about 8 mm, between about 0.8 mm and about 6 mm, between about 1 mm and about 5 mm, between about 2 mm and about 4 mm from the ion source. FIG. 2 also shows the location of inlet cone (also referred to as an atmospheric pressure interface) 1070 of ion transmission device 1030 as well as sample platform 1080 and atmospheric contaminant shield 1090. However one of ordinary skill in the art would appreciate that the ideal distance could be found by moving sample platform 1080 into close enough proximity to ion source 1010 that an electrical discharge is formed between ion source 1010 and sample platform 1080 at any given voltage.

During operation of the mass spectrometer and particularly during sample induction, a potential sufficient to ionize and volatilize sample present on the sample platform is applied between the ion source and the sample platform. In some embodiments, the potential applied is about 1.0 to about 4.0 kV, such as about 1.0 kV, about 1.1 kV, about 1.2 kV, about 1.3 kV, about 1.4 kV, about 1.5 kV, about 1.6 kV, about 1.7 kV, about 1.8 kV, about 1.9 kV, about 2.0 kV, about 2.1 kV, about 2.2 kV, about 2.3 kV, about 2.4 kV, about 2.5 kV, about 2.6 kV, about 2.7 kV, about 2.8 kV, about 2.9 kV, about 3.0 kV, about 3.1 kV, about 3.2 kV, about 3.3 kV, about 3.4 kV, about 3.5 kV, about 3.6 kV, about 3.7 kV, about 3.8 kV, about 3.9 kV, or about 4.0 kV, such as between about 1.0 kV and 2.0 kV, between about 1.5 kV and 2.5 kV, between about 2.0 kV and 3.0 kV, between about 2.5 kV and 3.5 kV, or between about 3.0 kV and 4.0 kV.

With reference to FIG. 2, sample platform 1080 is positioned between ion source 1010 and inlet cone 1070 of ion transmission device 1030 using the sample positioning assembly 1060. In some embodiments, sample platform 1080 is transverse or perpendicular to axis of ion source 1010 and inlet cone 1070 of ion transmission device 1030. Sample positioning assembly 1060 can be any configuration that allows for the consistent positioning of a sample within mass spectrometer 1000. In some embodiments, sample positioning assembly 1060 is configured such that it can be used to vary the distance between the sample platform and atmospheric contaminant shield 1090 is also positioned between ion source 1010 and inlet cone 1070 of ion transmission device 1030, and serves to substantially exclude oxygen and water vapor from sample platform 1080 and ion transmission device 1030. In addition, atmospheric contaminant shield 1090 also serves to maintain a layer of inert gas around the sample, which can be ionized in close proximity to sample platform 1080. Atmospheric contaminant shield 1090 can be formed of any non-conducting material and of any configuration, although substantially cylindrical tubes are preferred as they are more likely to present a laminar flow of the inert gas. Exemplary non-conducting materials include glass, such as borosilicate glass and plastic.

Figure 3:
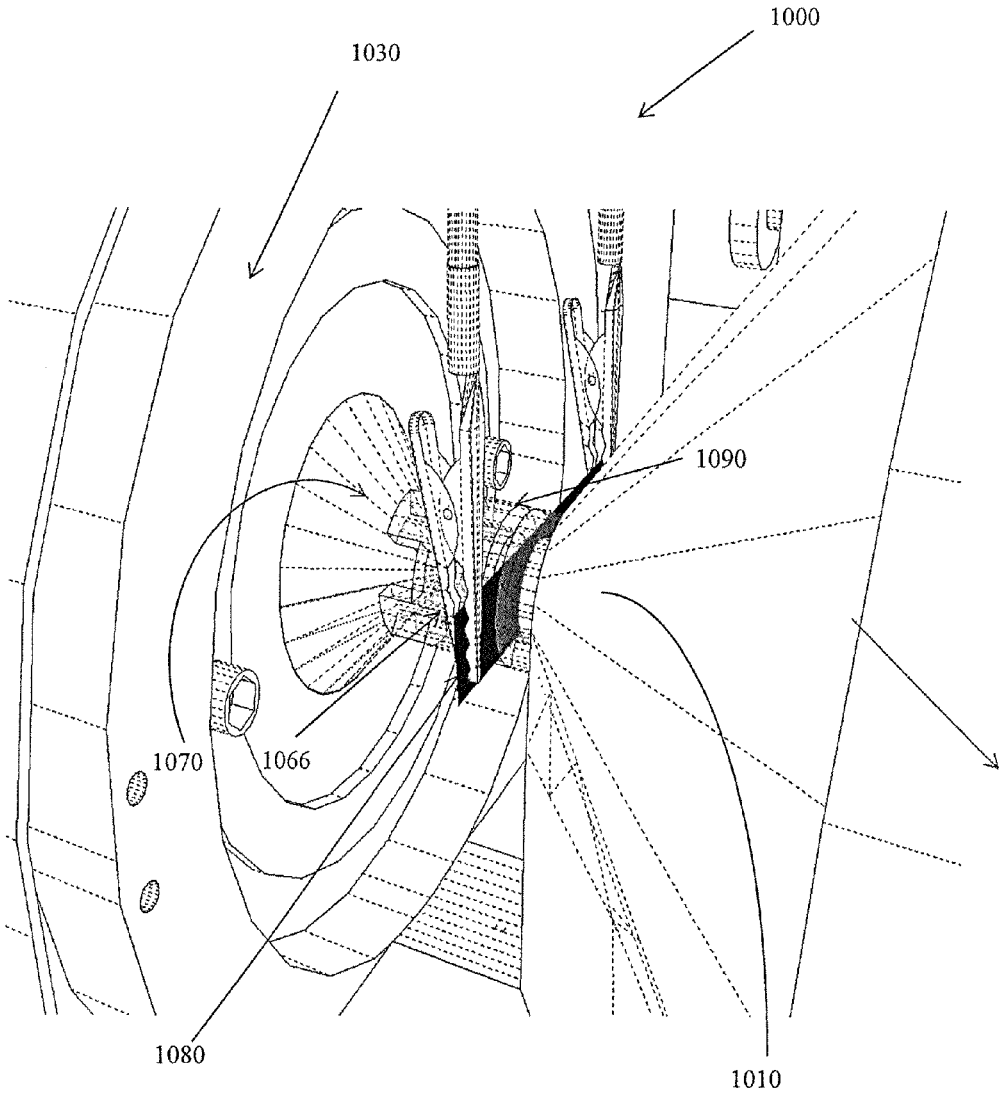
FIG. 3 is a diagram of the mass spectrometer shown in FIGS. 1 and 2, detailing the configuration of a sample platform and an atmospheric shield relative to the ion source and the inlet for the ion transmission device.

FIG. 3 details the configuration of mass spectrometer 1000, detailing the positions of ion source 1010, inlet cone 1070 of ion transmission device 1030, sample platform 1080 and atmospheric contaminant shield 1090. In the embodiment shown, ion source 1010, inlet cone 1070 of ion transmission device 1030 are along the same axis, while sample platform 1080 as shown is transverse or perpendicular to that axis. In addition atmospheric contaminant shield 1090 is shown as a substantially cylindrical tube, running in the same orientation as the axis of ion source 1010 and inlet cone 1070 of ion transmission device 1030. Sample platform 1080 is shown extending through a groove or slit in atmospheric contaminant shield 1090. FIG. 3 also details the connection between sample platform 1080 and sample positioning assembly 1060 (not shown in this diagram) which can be electrically grounded. In the embodiment shown, sample positioning assembly 1060 is connected to sample platform 1080 by clamps 1065, which extend from sample positioning assembly 1060. Any means of securing the sample platform 1080 in position is contemplated, including, but not limited to, fasteners such as screws, clips, adhesives, bolts and the like. Clamps 1065 are shown as they are a convenient means of securing sample platform 1080 to sample positioning assembly 1060.

Figure 4:
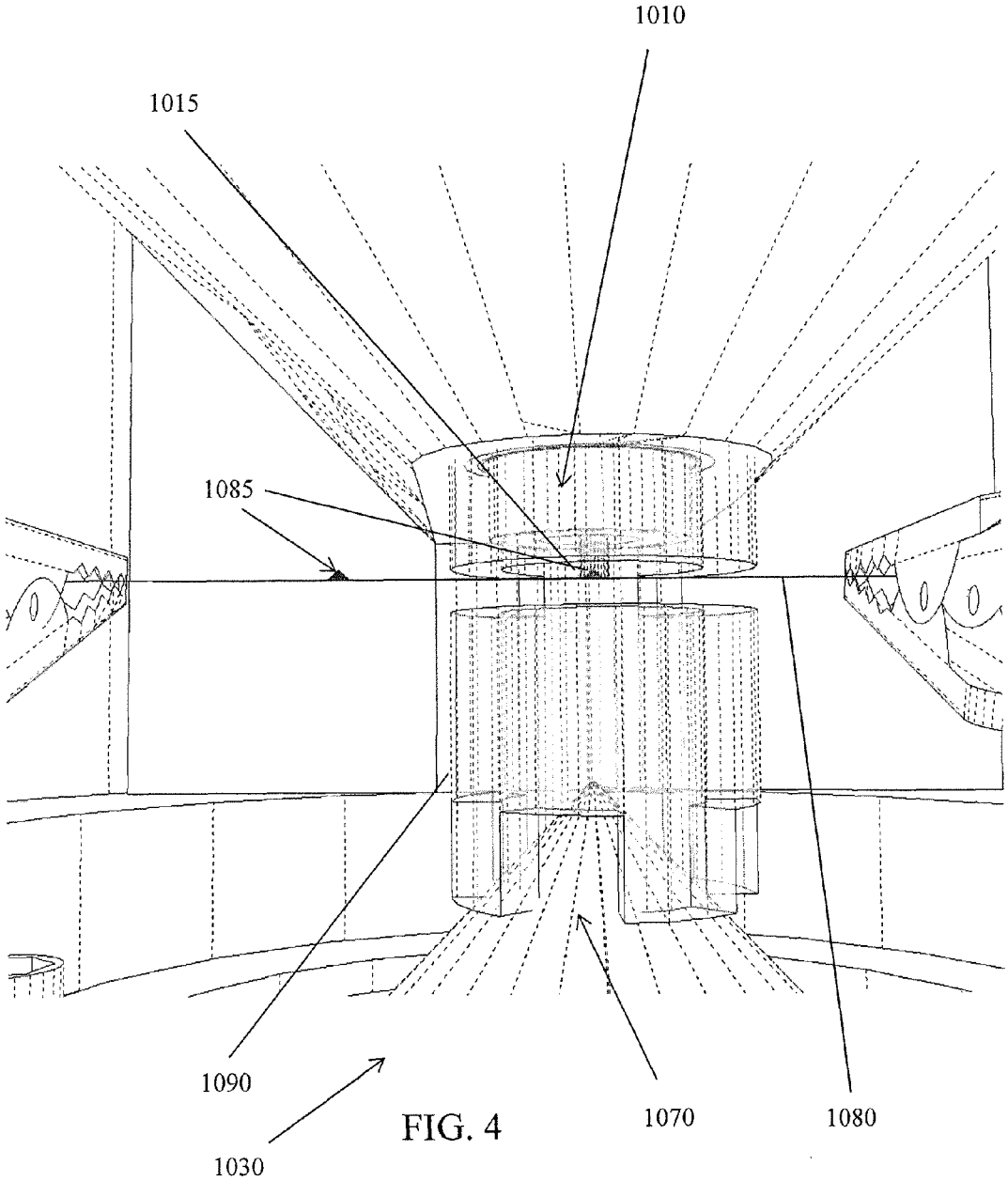
FIG. 4 is a diagram of the mass spectrometer analyzer shown in FIGS. 1-3, detailing the configuration of a sample platform and an atmospheric shield relative to the ion source and the inlet for the ion transmission device and the impact of the electrical discharge on the sample platform.

FIG. 4 is a view, detailing the configuration of ion source 1010, inlet cone 1070 of ion transmission device 1030, sample platform 1080 and atmospheric contaminant shield 1090. FIG. 4 shows electrical discharge 1015 from ion source 1010 impacting sample platform 1080. In this view, sample platform 1080 includes indentions or recesses 1085, which view from the other side would be seen as protrusions. Indentations or recesses 1085 in sample platform 1080 serve as both to locate a sample on sample platform 1080, for example within indentations or recesses 1085 and to direct the discharge from ion source 1010 incident to the position of the sample on sample platform 1080. During operation of the mass spectrometer, a potential is maintained between ion source 1010 and sample platform 1080, thus electrical discharge from ion source 1010 is directed to indentations or recesses 1085. The sample is for example, placed in the indentation and dried, for example at too temperature so that it adheres to the surface of indentation or concave surface of the indentation. As shown in this view, sample platform 1080 is positioned perpendicular or transverse to ion source 1010 such that indentations or recesses 1085 are protruding toward ion source 1010, as protrusions. Thus, electrical discharge 1015 will impact indentations or recesses 1085 or their protuberance (for example a convex surface), which would result in both the volatilization and ionization of a sample dried within indentations or recesses 1085 on sample platform 1080. Providing protuberant surfaces or the indentations facing the ion source provides a defined point to which the electrical discharge can impact.

Figure 5:
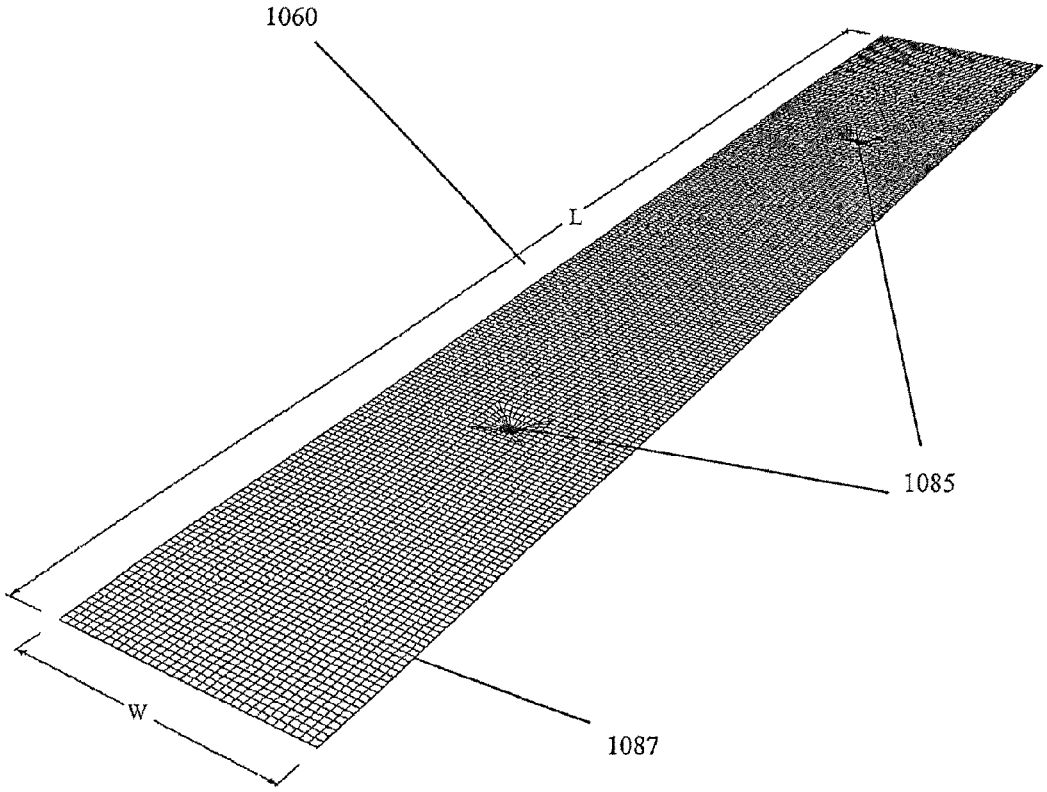
FIG. 5 is a diagram of an exemplary sample platform.
Figure 9:
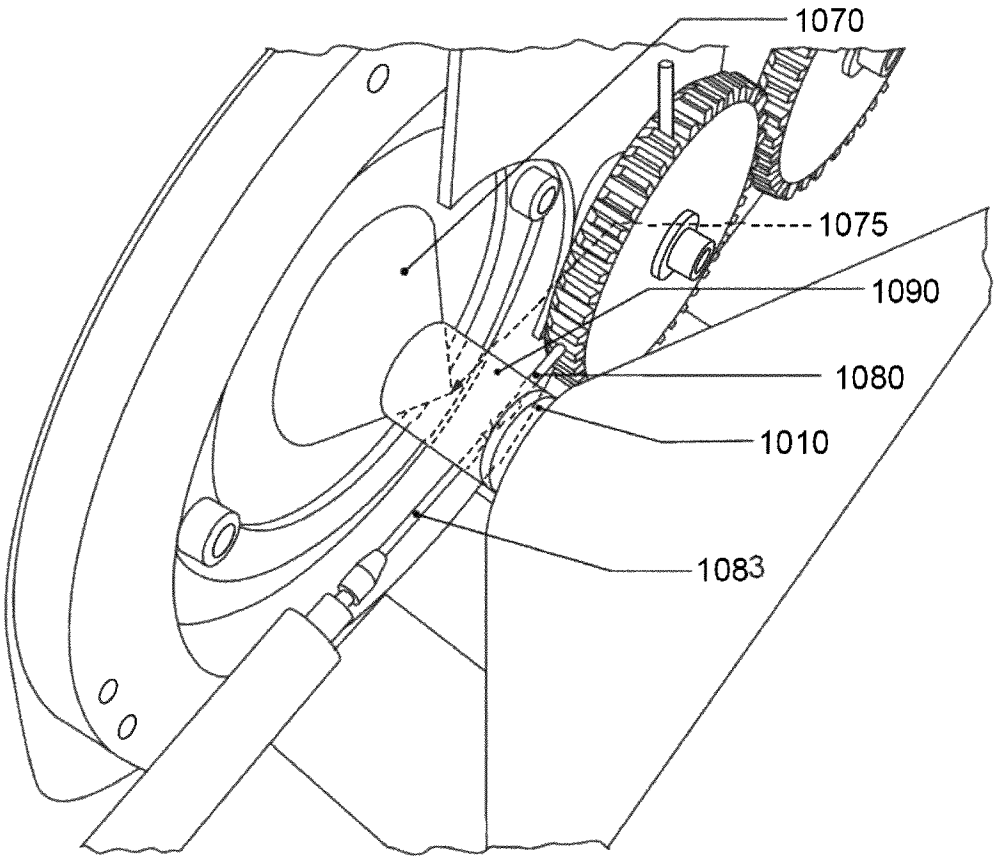
FIG. 9 is an example of a re-engineered sample introduction chamber utilizing gear work to position pin holding the sample in the ion stream.

FIG. 5 is a detail of an embodiment of sample platform 1080, which includes indentations/recesses 1085 and is composed of a material which includes perforations, holes or other passage ways 1087. In the embodiment of sample platform shown in FIG. 5, sample platform 1087 has width (W) of about 0.1 inches to about 1 inch and length (L) which is about 1 inch to about 4 inches, although the exact dimensions can vary. Because the material present in the sample needs to be volatilized, for example, by heat energy from the electrical discharge from the ion source, it is advantageous for sample platform 1080 to be composed of a material or object with a low thermal mass or heat capacity, so that the maximum thermal energy of the electrical discharge is transferred to the sample. Thus, a metallic wire mesh is an ideal material. However, while sample platform 1080 is shown as a mesh, such as a wire mesh, the sample platform can be made of various materials, such as perforated foils or metallic or non-metallic (for example, ceramic) materials that have perforations. In some embodiments has perforations covering at least about 50%, such as at least about 60%, at least about 70%, at least about 80%, at least about 90%, at least about 95%, at least about 96%, at least about 97%, at least about 98%, at least about 99%, at least about 99.9% or even greater than 99.9% of the area of sample platform 1080. In some embodiments, sample platform 1080 has a porosity, as measured by total volume of void divided by total volume, of at least about 50%, such as at least about 60%, at least about 70%, at least about 80%, at least about 90%, at least about 95%, at least about 96%, at least about 97%, at least about 98%, at least about 99%, at least about 99.9% or even greater than 99.9% of the area of sample platform 1080. In some examples, a metallic material comprises nickel, a nickel alloy, steel, stainless steel, titanium, aluminum, aluminum alloy or a combination thereof. In other examples (and as shown in FIG. 9), the sample platform can be made of a small pin or wire. The number of indentations/recesses 1085 can also vary, while the embodiment shown in FIG. 5 shows two indentations, it is envisioned that sample platform 1080 could contain multiple indentations 1087 for placing one or more samples, for example configured in a line or square circle or other shape relative to each other (such a circle, rectangle, diamond and the like), for example, configured to allow for the continuous (or near continuous) analysis of multiple samples on sample platform 1080 to be analyzed by simply repositioning the sample platform (for example, via sample positioning assembly 1060) such that a new indentation is brought into proximity of the ion source. It is also envisioned that one or more of the indentations could be devoid of a sample, for example, as a blank or control, or that the indentations could carry samples of known microorganisms for example as comparative controls.

Figure 6:
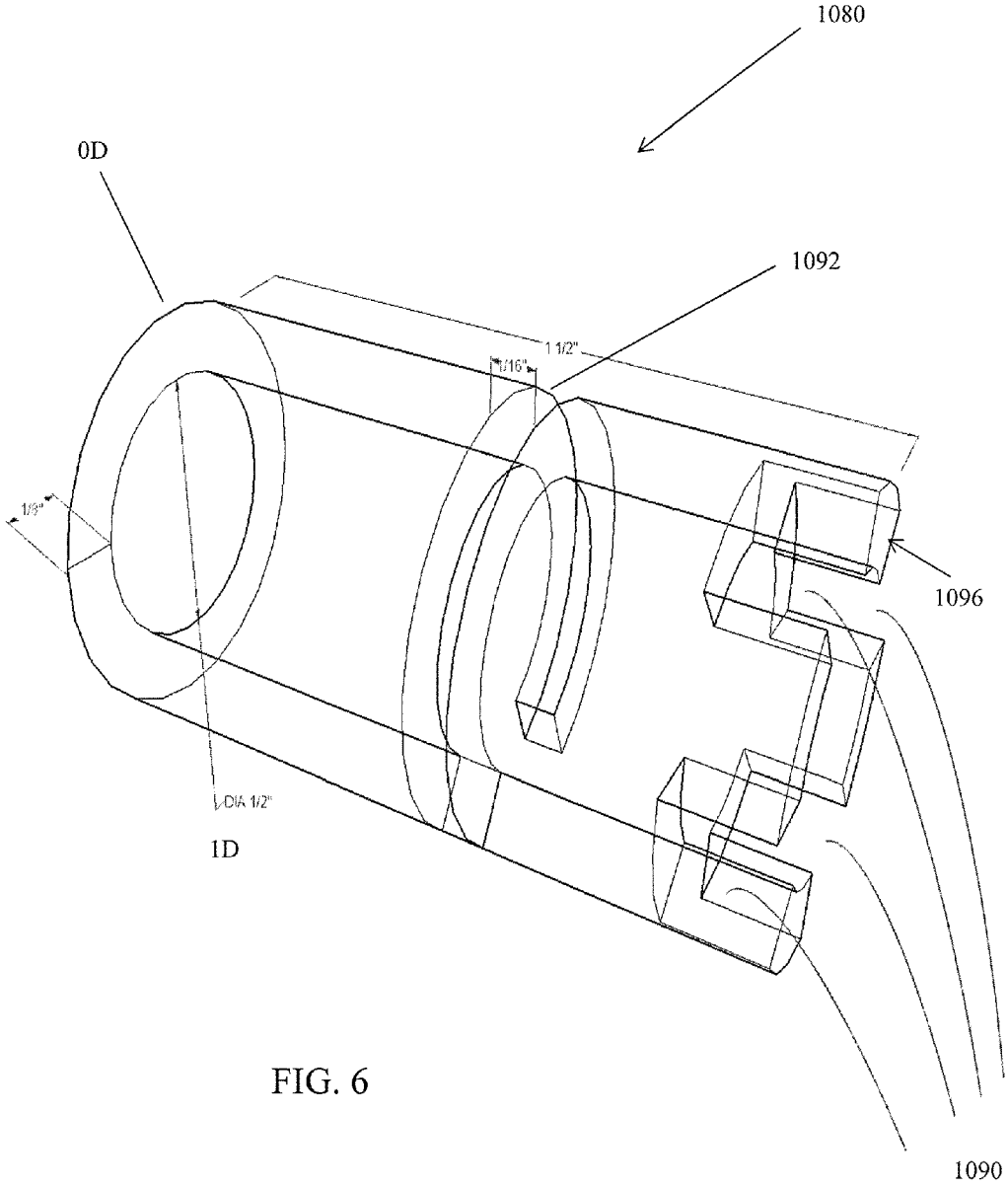
FIG. 6 is an exemplary atmospheric contaminant shield configured for use in the mass spectrometer shown in FIGS. 1-4.

FIG. 6 is a detail of an embodiment of a substantially cylindrical atmospheric contaminant shield 1090. Atmospheric contaminant shield 1090 includes traverse slit or groove 1092 with width W, (which is about 0.1 inches to about 0.5 inches, such as 0.1 inches, about 0.2 inches, about 0.3 inches, about 0.4 inches, or about 0.5 inches), configured to accommodate sample platform 1080 (not shown in this diagram). Slit 1092 extends approximately 180 degrees or more around the circumference of atmospheric contaminant shield 1090 to accommodate sample platform 1080 during operation of the mass spectrometer. Atmospheric contaminant shield 1090 has inner diameter ID (with a diameter of about 0.25 inches to about 1 inch, such as about 0.25 inches, about 0.3 inches, about 0.4 inches, about 0.5 inches, about 0.6 inches, about 0.7 inches about 0.8 inches, about 0.9 inches or about, 1.0 inch, for example about 0.25 inches to about 0.5 inches, about 0.4 inches to about 0.7 inches, or about 0.5 inches to about 1.0 inches), outer diameter OD (with a diameter of about 0.3 inches to about 2 inches, such as about 0.3 inches, about 0.4 inches, about 0.5 inches, about 0.6 inches, about 0.7 inches about 0.8 inches, about 0.9 inches, about 1.0 inch, about 1.3 inches, about 1.4 inches, about 1.5 inches, about 1.6 inches, about 1.7 inches about 1.8 inches, about 1.9 inches or about, 2.0 inches for example about 0.3 inches to about 1.0 inch, about 0.75 inches to about 1.5 inches, or about 0.5 inches to about 2.0 inches), and length L (with a length of about 0.3 inches to about 2 inches, such as about 0.3 inches, about 0.4 inches, about 0.5 inches, about 0.6 inches, about 0.7 inches about 0.8 inches, about 0.9 inches or about, 1.0 inch, about 1.3 inches, about 1.4 inches, about 1.5 inches, about 1.6 inches, about 1.7 inches about 1.8 inches, about 1.9 inches or about, 2.0 inches for example about 0.3 to about 1.0 inch, about 0.75 inches to about 1.5 inches, or about 0.5 to about 2.0 inches). End 1096 of atmospheric contaminant shield 1090 is configured to fit over inlet cone 1070 of ion transmission device 1030 and includes configured with several gas relief slots 1098, such as longitudinal slots that expend from a distal end of shield 1090. In the embodiment shown in FIG. 6, substantially cylindrical atmospheric contaminant shield 1090 is shown with four rectangular slots 1098 extending from end 1096. The number and shape of gas relief slits 1098 can vary so long as they allow the inert gas to escape without pressure build up. In some embodiments, atmospheric contaminant shield 1090 works to exclude atmospheric contaminants, such as atmospheric water vapor and atmospheric oxygen, by sequestering an inert gas within atmospheric contaminant shield 1090. As the inert gas flows from the ion source, a positive pressure of inert gas is maintained within atmospheric contaminant shield 1090. This positive pressure keeps atmospheric gases, such as atmospheric water vapor and atmospheric oxygen, from entering traverse slit or groove 1092 or gas relief slots 1098, and thus substantially excludes atmospheric gases, such as atmospheric water vapor and atmospheric oxygen from the sample.

FIG. 9 shows the configuration of an alternative embodiment of mass spectrometer 1000. In this embodiment, sample platform 1080 is shown as a pin and the electrical charge to the pin is provided by discharge electrode 1092. Sample platform 1080 is positioned between ion source 1010 and inlet cone 1070 of ion transmission device 1030. The position of atmospheric contaminant shield 1090 is shown as is sample positioning assembly 1060, for calibrated positioning of the sample at a desired distance from the ion source 1010 to promote electric discharge between ion source 1010 and sample platform 1080. Sample positioning assembly 1060 shown in FIG. 9 includes a gear assembly which rotates sample platform 1080 into position between ion source 1010 and inlet cone 1070 of ion transmission device 1030, where sample platform 1080 contacts discharge electrode 1092. The gear assembly is calibrated to move the sample or sample platform 1080 into the path of the electrical discharge between discharge electrode 1092 and ion source 1010 at a preselected distance that promote discharge. In some embodiments, the potential is applied to sample platform 1080 by discharge electrode 1092.

B. Methods of Analysis

Disclosed herein are mass spectrometric methods suitable for the detection of an analyte in a sample. In some embodiments, the methods detect and/or identify microorganisms in a sample, such biological sample and/or an environmental sample. In some embodiments, the methods detect a compound (such as a chemical compound) in a sample, such biological sample and/or an environmental sample, for example an adulterant (both chemical and biological) in foods, feed, and products. In some embodiments, the disclosed methods produce an analyte, analyte fragment, and/or analyte adduct ions for mass spectrographic analysis. The analyte is maintained at atmospheric pressure and can form analyte ions, analyte fragment ions, and/or analyte adduct ions.

In some examples, the methods include generating a mass spectra profile/fingerprint of a sample to determine if the sample includes microorganisms, for example a pathogen, such as a bacterial, a viral, a fungal or a parasitic pathogen. The mass spectra profile/fingerprint of the sample can then be interrogated to determine if there is a microorganism present in the sample and in some examples, what that microorganism might be, for example by analyzing the spectra obtained using pattern recognition methods, such as those described in section C. In some examples, the sample analyzed can include at least about 5000 cells, such that the lower limit of reproducible detection is about 5000 cells. In some examples, the upper limit is about 50,000 cells, about 500,000 cells, about 5,000,000 cells or even greater than about 5,000,000 cells. In some examples, the methods include generating a mass spectrum profile/fingerprint of a sample to determine if the sample includes a compound of interest (such as a chemical compound), for example an adulterant (both chemical and biological). The mass spectrum profile/fingerprint of the sample can then be interrogated to determine if there is a compound of interest present in the sample and in some examples, what that compound of interest might be, for example by analyzing the spectra obtained using pattern recognition methods, such as those described in section C. In some embodiments of the disclosed method, a sample platform which includes a sample is positioned adjacent to an ion source. In some embodiments, the sample is dried on the sample platform, for example to remove residual moisture that may interfere with the analysis. In some examples, the sample analyzed can include at least about 5000 cells, such that the lower limit of reproducible detection is about 5000 cells. However in some examples samples of greater than about 5000 cells are used, such as samples with about 10,000 cells, 50,000 cells, about 500,000 cells, about 5,000,000 cells or even greater than about 5,000,000 cells.

An electrical discharge, such as a spark, brush or corona discharge is caused between the ion source and the sample platform at a position on the platform where the sample is placed. The electrical discharge is selected such that it is sufficient to ionize and volatize molecules, such as biological molecules, within the sample. The ionized and volatized biomolecules can then be analyzed with a mass analyzer to determine the biological molecules within the sample, for example using an ion transmission device to collect the biological molecules and a time of flight mass analyzer to analyze the mass to charge ratio of the ions and thereby allow a mass spectrum profile/fingerprint to be generated. In some examples, the potential applied is about 1.0 kV to about 4.0 kV, such as about 1.0 kV, about 1.1 kV, about 1.2 kV, about 1.3 kV, about 1.4 kV, about 1.5 kV, about 1.6 kV, about 1.7 kV, about 1.8 kV, about 1.9 kV, about 2.0 kV, about 2.1 kV, about 2.2 kV, about 2.3 kV, about 2.4 kV, about 2.5 kV, about 2.6 kV, about 2.7 kV, about 2.8 kV, about 2.9 kV, about 3.0 kV, about 3.1 kV, about 3.2 kV, about 3.3 kV, about 3.4 kV, about 3.5 kV, about 3.6 kV, about 3.7 kV, about 3.8 kV, about 3.9 kV, or about 4.0 kV, such as between about 1.0 kV and 2.0 kV, between about 1.5 kV and 2.5 kV, between about 2.0 kV and 3.0 kV, between about 2.5 kV and 3.5 kV, or between about 3.0 kV and 4.0 kV. In some examples, the sample platform is positioned such that is about 1 centimeter (cm) or less from the ion source, such as less than about 10 millimeters (mm), less than about 9 mm, less than about 8 mm, less than about 7 mm, less than about 6 mm, less than about 5 mm, less than about 4 mm, less than about 3 mm, less than about 2 mm, less than about 1 mm, less than about 0.5 mm, less than about 0.4 mm, less than about 0.3 mm, less than about 0.2 mm, less than about 0.1 mm from the ion source, for example between about 0.2 mm and about 10 mm, between about 0.4 mm and about 8 mm, between about 0.8 mm and about 6 mm, between about 1 mm and about 5 mm, between about 2 mm and about 4 mm from the ion source.

In some embodiments, the sample is shielded from atmospheric contaminants during the electrical discharge, for example using a physical shield, a layer of inert gas or a combination thereof. In some examples, the sample is shielded from atmospheric oxygen, atmospheric water vapor or a combination thereof. Because of the use of an electrical discharge, if a physical shield is used, it should be constructed of a non-conductive or insulating material positioned between the ion source and ion transmission device, such as a glass, plastic, ceramic, or other like non-conductive or insulating materials known to one of ordinary skill in the art. Preferably, the inert gas consists substantially entirely of one or more of nitrogen and noble gases. The inert gas can be introduced from a gas cylinder into the atmospheric contaminant shield at a positive pressure.

The sample platform selected for use in the disclosed methods typically has low thermal mass to facilitate heat transfer into the sample from the electrical discharge. The sample platform should also be constructed of a conductive material, such as a metallic material, including, but not limited to, nickel, a nickel alloy, steel, stainless steel, titanium, aluminum, aluminum alloy or a combination thereof, such that it can act as a counter or discharge electrode to the ion source. In some examples, the sample platform is formed from a perforated material, such as a wire mesh having sample presentation regions where the sample is placed for analysis. In some examples, the sample platform and/or sample presentation region includes a recess or indentation for positioning the sample to be analyzed. In some examples, the recess protrudes from the sample platform forming a point that is positioned toward the ion source thereby providing a point of impact for the electrical discharge. Although it not necessary to have a perforated sample platform with indentations, there are several advantage to using such a sample platform. A sample, such as a biological sample deposited as a 1-microliter sized droplet will "sit" comfortably in the indentation until it is dry (and will not migrate), when dried, the biological sample is—more often than not—somewhat invisible to the naked eye, making it harder to target the ion beam onto the biological sample during spectra acquisition, and just as lightning travels through the air, sparks are known to choose the shortest distance and therefore will preferably hit pointed objects, in this case the electrically conducting indentation from the bottom.

In some embodiments of the disclosed method, the fingerprint or profile spectrum of the sample is selected by selecting the individual spectrum in which a descriptor peak in the mass spectrum is at a maximum. A sample containing a microorganism, such as a pathogen, for example, a pathogenic bacteria, is subject to intense heat during electronic discharge, such as a spark or corona discharge, hence there is an ever changing mass spectrum over time sparks are applied. When integrated over the entire duration of a run, a global mass spectrum is obtained. When sparking bacteria, at one point in time (for example between about 0.5-2 seconds after sparking starts), characteristic descriptor peak(s) will stand out beyond 250 m/z, such as between about 250 m/z and about 1500 m/z, for example about 250 m/z, about 300 m/z, about 350 m/z, about 400 m/z, about 450 m/z, about 500 m/z, about 550 m/z, about 600 m/z, about 650 m/z, about 700 m/z, about 750 m/z, about 800 m/z, about 950 m/z, about 1000 m/z, about 1050 m/z, about 1100 m/z, about, 1150 m/z, about 1200 m/z, about 1250 m/z, about 1300 m/z, 1350 m/z, about 1400 m/z, about 1450 m/z, or about 1500 m/z. In some examples a characteristic descriptor peak is found at about 560.5 m/z, 343.24 and/or 313.45 m/z. Whenever a unique peak appears, the whole spectrum harbors a wealth of valuable spectral information. When back-integrating the ion intensity profile for a particular descriptor peak, an ion intensity profile graph can be obtained. The point at which a particular descriptor peak is maximized does not necessarily correspond to the highest point within the total ion intensity graph. When integrating mass spectra from the point at which a particular descriptor peak is maximized, representative and reproducible mass spectra are obtained for a particular biological sample. The silhouettes of mass spectra acquired in this manner turn out to be quite similar. This is what one would expect since the two spectra originate from two different samples of the same bacterium.

The descriptor peak is typically used to identify the most useful and representative scan for pattern recognition purposes when the conditions for spectral acquisition mean that scans last a long time, e.g. the low and high volatility components of the biochemical mixture are spread out widely in time along the time dimension of a chromatogram. It is desirable to integrate over the entire complex of acquired scans to obtain a total spectrum representing all components appropriately and using that average or total rather than any single scan as the "pattern" to identify the bacterium. Typically when a sample platform having low thermal mass is used there is no need to find a descriptor ion. But if the signal is spread out for any reason (because it takes a time to heat the sample), then it is useful to define the most relevant, reproducible, consistent, and information rich scan to serve that purpose, which can be done with a descriptor peak. Thus in some embodiments, a descriptor peak is used to select a spectrum. In some embodiments, the operator of the mass spectrometer selects a descriptor peak based on visual inspection of the mass spectrum obtained for a given sample or samples. In some examples, a descriptor peak a high mass ion that appears in a global mass spectrum of a microorganism sample. In some examples, a descriptor peak is selected that appears in a global mass spectrum of a microorganism sample.

Once the fingerprint region of the spectrum is obtained, it can be compared to a data base to determine the identity of the microorganism, or microorganisms present in the sample, for example a data base of spectra obtained from known organisms. Methods of database construction and interrogation using pattern recognition can be found for example in U.S. Pat. No. 6,996,472, issued Feb. 7, 2006, which is hereby incorporated by reference in its entirety. Similarly a compound of interest can be identified in a sample by comparison with a data base of mass spectrum of known compounds.

Appropriate samples for use in the methods disclosed herein include any conventional sample for which information about a sample is desired. In some examples the sample is a biological sample. For example those obtained from, excreted by or secreted by any living organism, such as eukaryotic organisms including without limitation, multicellular organisms (such as animals, including samples from a healthy or apparently healthy human subject or a human patient affected by a condition or disease to be diagnosed or investigated, such as cancer), clinical samples obtained from a human or veterinary subject, for instance blood or blood-fractions, biopsied tissue. Standard techniques for acquisition of such samples are available. See, for example Schluger et al., *J. Exp. Med.* 176:1327-1333 (1992); Bigby et al., *Am. Rev. Respir. Dis.* 133:515-18 (1986); Kovacs et al., *NEJM* 318: 589-593 (1988); and Ognibene et al., *Am. Rev. Respir. Dis.* 129:929-932 (1984). Biological samples can be obtained from any organ or tissue (including a biopsy or autopsy specimen) or can comprise a cell (whether a primary cell or cultured cell) or medium conditioned by any cell, tissue or organ. In some examples, a sample is a sample taken from the environment, (e.g. an environmental sample), such as a water, soil, or air sample, a swab sample taken from surfaces (for instance, to check for microbial contamination), and the like. In some examples samples are used directly. In other examples samples are purified or concentrated before they are analyzed.

In some examples, the sample is a biological sample. In some examples the sample is an environmental sample. In some example, the sample includes, or is suspected of including, microorganisms.

C. Pattern Recognition Methods

Pattern recognition programs useful for practicing the disclosed methods are of two major types; statistical and artificial intelligence.

Statistical methods include Principal Component Analysis (PCA) and variations of PCA such as linear regression analysis, cluster analysis, canonical variates, and discriminant analysis, soft independent models of class analogy (SIMCA), expert systems, and auto spin (see, for example, Harrington, RESolve Software Manual, Colorado School of Mines, 1988, incorporated by reference). Other examples of statistical analysis software available for principal-component-based methods include SPSS (SPSS Inc., Chicago, Ill.), JMP (SAS Inc., Cary N.C.), Stata (Stata Inc., College Station, Tex.), SIRIUS (Pattern Recognition Systems Ltd., Bergen, Norway) and Cluster (available to run from entropy:~dblank/public_html/cluster).

Artificial intelligence methods include neural networks and fuzzy logic. Neural networks may be one-layer or multilayer in architecture (See, for example, Zupan and Gasteiger, Neural Networks for Chemists, VCH, 1993, incorporated herein by reference). Examples of one-layer networks include Hopfield networks, Adaptive Bidirectional Associative Memory (ABAM), and Kohonen Networks. Examples of Multilayer Networks include those that learn by counter-propagation and back-propagation of error. Artificial neural network software is available from, among other sources, Neurodimension, Inc., Gainesville, Fla. (Neurosolutions) and The Mathworks, Inc., Natick, Mass. (MATLAB Neural Network Toolbox).

The technique of principal component analysis (PCA) and related techniques consist of a series of linear transformations of the original m-dimensional observation vector (e.g. the mass spectrum of microorganism consisting of the ion masses and intensities) into a new vector of principal components (or, for example, canonical variates), that is a vector in principal component factor space (or, for example, canonical variate factor space). Three consequences of this type of transformation are of importance in chemotaxonomic studies. First, although a maximum of m principal axes exist, it is generally possible to explain a major portion of the variance between microorganisms with fewer axes. Second, the principal axes are mutually orthogonal and hence the principal components are uncorrelated. This greatly reduces the number of parameters necessary to explain the relationships between samples. Third, the total variance of the samples is unchanged by the transformation to Principal Components. Similarly, for canonical variates, which are orthogonal linear combinations of the PCs, the total variance remaining in those PCs selected for use is unchanged by the transformation. In the CVs it is partitioned in such a way that variance between groups of samples is maximized and variance within groups of samples is minimized. Further discussion of this method and related methods may be found, for example, in Kramer, R., Chemometric Techniques for Quantitative Analysis, Marcel Dekker, Inc., 1998.

Pattern recognition may be performed (for example to compare fingerprint spectra in a library database of such fingerprint spectra) using multivariate methods, such as those performed by the programs above or by any number of artificial neural network techniques. Artificial neural network software is available from, among other sources, Neurodimension, Inc., Gainesville, Fla. (Neurosolutions) and The Mathworks, Inc., Natick, Mass. (MATLAB Neural Network Toolbox).

D. Computing Environments

The techniques and solutions described herein can be performed by software, hardware, or both of a computing environment, such as one or more computing devices. For example, computing devices include server computers, desktop computers, laptop computers, notebook computers, handheld devices, netbooks, tablet devices, mobile devices, PDAs, and other types of computing devices.

Figure 17:
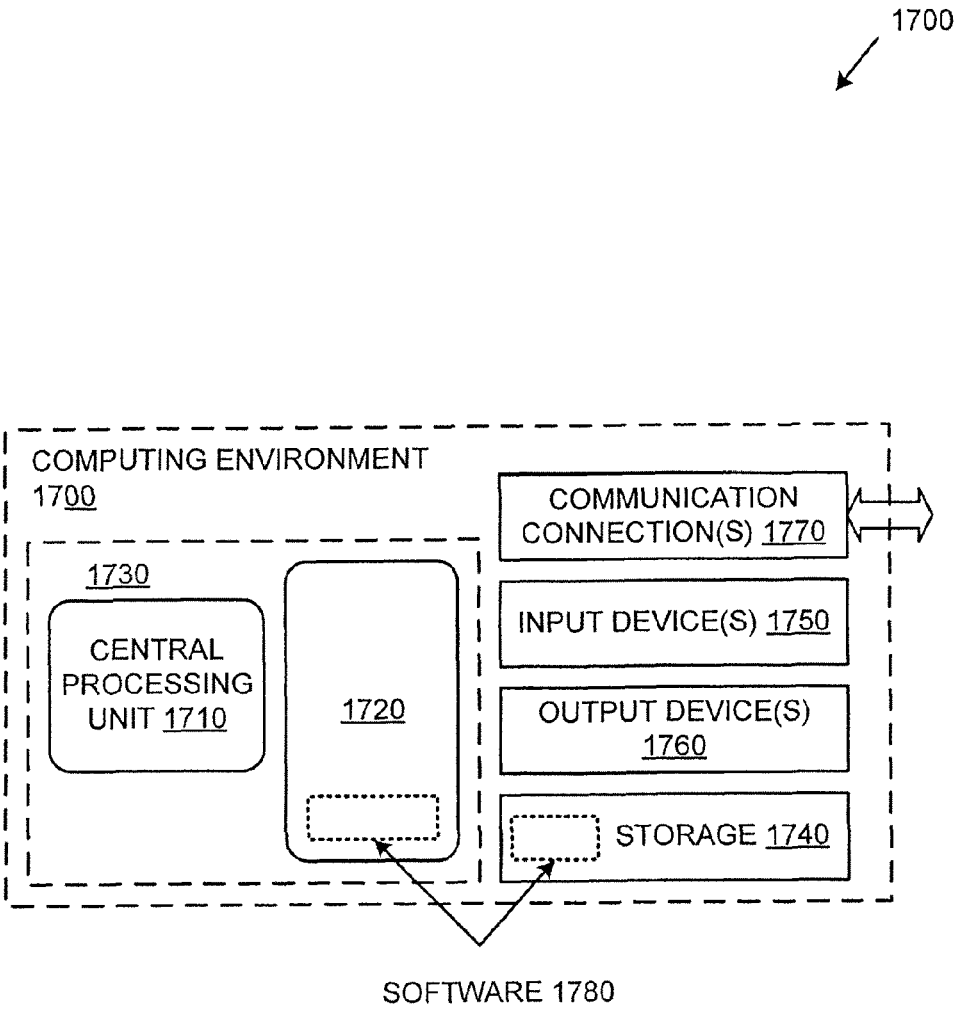
FIG. 17 is an exemplary computing environment for carrying out aspects of the present disclosure.

FIG. 17 illustrates a generalized example of a suitable computing environment 1700 in which the described technologies can be implemented. The computing environment 1700 is not intended to suggest any limitation as to scope of use or functionality, as the technologies may be implemented in diverse general-purpose or special-purpose computing environments. For example, the disclosed technology may be implemented using a computing device comprising a processing unit, memory, and storage storing computer-executable instructions implementing methods disclosed herein. The disclosed technology may also be implemented with other computer system configurations, including hand held devices, multiprocessor systems, microprocessor-based or programmable consumer electronics, network PCs, minicomputers, mainframe computers, a collection of client/server systems, and the like. The disclosed technology may also be practiced in distributed computing environments where tasks are performed by remote processing devices that are linked through a communications network. In a distributed computing environment, program modules may be located in both local and remote memory storage devices With reference to FIG. 17, the computing environment 1700 includes at least one processing unit 1710 coupled to memory 1720. In FIG. 17, this basic configuration 1730 is included within a dashed line. The processing unit 1710 executes computer-executable instructions and may be a real or a virtual processor. In a multi-processing system, multiple processing units execute computer-executable instructions to increase processing power. The memory 1720 may be volatile memory (e.g., registers, cache, RAM), non-volatile memory (e.g., ROM, EEPROM, flash memory, etc.), or some combination of the two. The memory 1720 can store software 1780 implementing any of the technologies described herein.

A computing environment may have additional features. For example, the computing environment 1700 includes storage 1740, one or more input devices 1750, one or more output devices 1760, and one or more communication connections 17170. An interconnection mechanism (not shown) such as a bus, controller, or network interconnects the components of the computing environment 1700. Typically, operating system software (not shown) provides an operating environment for other software executing in the computing environment 1700, and coordinates activities of the components of the computing environment 1700.

The storage 1740 may be removable or non-removable, and includes magnetic disks, magnetic tapes or cassettes, CD-ROMs, CD-RWs, DVDs (such as DVD-Rs, DVD-RWs, "DVD+Rs, and DVD+RWs), or any other computer-readable media which can be used to store information and which can be accessed within the computing environment 1700. The storage 1740 can store software 1780 containing instructions for any of the technologies described herein.

The input device(s) 1750 may be a touch input device such as a keyboard, mouse, pen, or trackball, a voice input device, a scanning device, or another device that provides input to the computing environment 1700. For audio, the input device(s) 1750 may be a sound card or similar device that accepts audio input in analog or digital form, or a CD-ROM reader that provides audio samples to the computing environment. The output device(s) 1760 may be a display, printer, speaker, CD-writer, or another device that provides output from the computing environment 1700.

The communication connection(s) 1770 enable communication over a communication mechanism to another computing entity. The communication mechanism conveys information such as computer-executable instructions, audio/video or other information, or other data. By way of example, and not limitation, communication mechanisms include wired or wireless techniques implemented with an electrical, optical, RF, infrared, acoustic, or other carrier.

The techniques herein can be described in the general context of computer-executable instructions, such as those included in program modules, being executed in a computing environment on a target real or virtual processor. Generally, program modules include routines, programs, libraries, objects, classes, components, data structures, etc., that perform particular tasks or implement particular abstract data types. The functionality of the program modules may be combined or split between program modules as desired in various embodiments. Computer-executable instructions for program modules may be executed within a local or distributed computing environment.

In view of the many possible embodiments to which the principles of our invention may be applied, it should be recognized that illustrated embodiments are only examples of the invention and should not be considered a limitation on the scope of the invention. Rather, the scope of the invention is defined by the following claims. We therefore claim as our invention all that comes within the scope and spirit of these claims.

EXAMPLES

Example 1

This example describes methods used to identify micro-organisms using spark induced ionization of biological samples that include micro-organisms.

*Vibrio vulnificus* ATCC #27562 was obtained from ATCC (Manassas, Va.). Stainless steel dowel pins (0.125"×1") were used. Trypticase soy agar (TSA) was obtained from Fisher Scientific (www.fishersci.com). A JEOL AccuTOF DART mass spectrometer (MS) (Peabody, Mass.) with the DART ion source reengineered as described herein served as the MS platform.

*V. vulnificus* was cultured in TSB at 37° C. for 48 hours. Soon after, cells were harvested and purified from residual TSB using tissue culture water and centrifugation at 8,000 rpm. Purified bacterial suspension samples (analyte) were manually deposited as a thin film on the flat surface of the sterile stainless steel pins. Samples were air dried for 15 minutes at 50° C. Pins carrying the dried analyte were introduced into a helium stream at 350° C. The discharge was initiated and mass spectra were acquired. Spectral fingerprints of bacteria were obtained with a high degree of reproducibility by selecting the mass spectrum obtained when an indicator ion at 560.5 m/z achieved maximum intensity. Principal component and cluster analyses were performed using ArrayTrack™ (National Center for Toxicological Research (NCTR), FDA) were used to corroborate spectral similarities.

Figure 7:
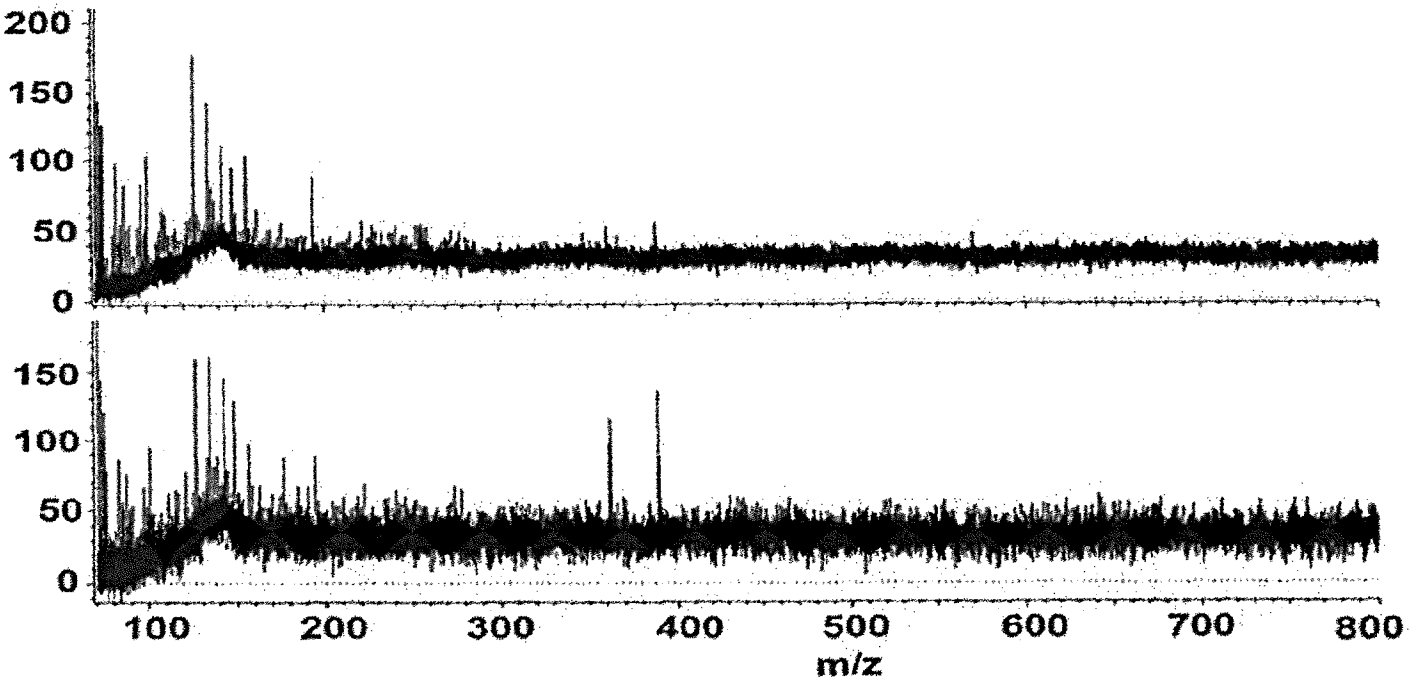
FIG. 7 is the mass spectra of two *V. vulnificus* samples obtained under conventional metastable atom bombardment (MAB). Note the low peak intensity and low signal to noise ratio.

It was discovered that DII occurred while repositioning a stainless steel pin close to the grid of the metastable atomic bombardment (MAB) ion source gun. Unexpectedly, examination of the spectra obtained revealed that peak intensities increased 490-fold, and the spectral information (FIG. 8) is much greater than that obtained on the same instrument but using only MAB (FIG. 7). Mass spectra obtained from microbiological analytes through conventional pyrolysis yielded low intensity peaks (FIG. 7).

Figure 8:
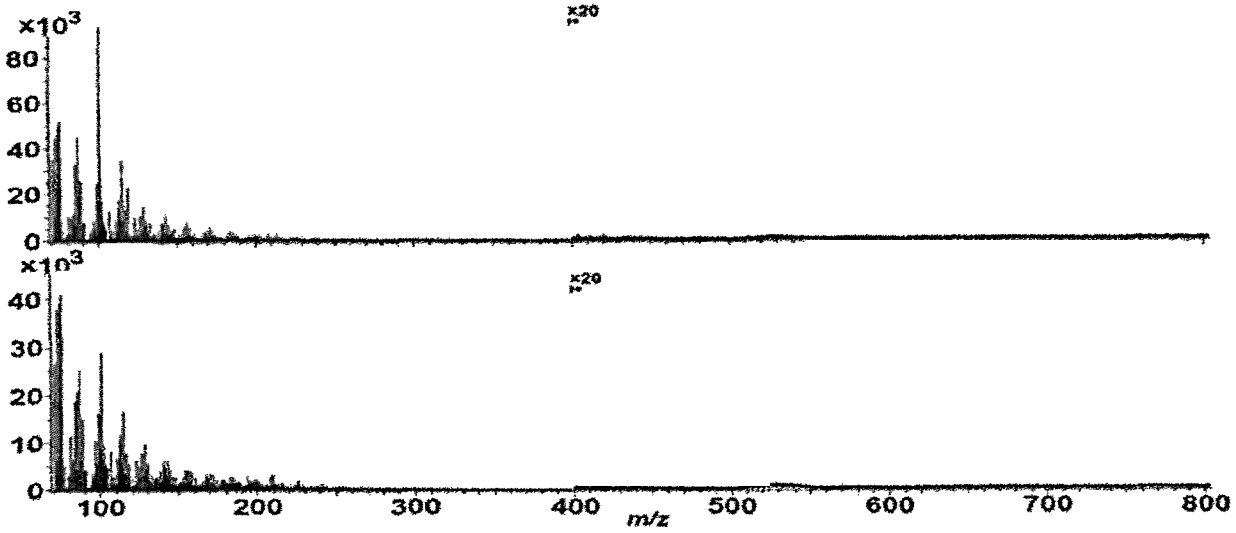
FIG. 8 is the mass spectra of two *V. vulnificus* samples (same samples used in FIG. 7) obtained under direct impact ionization (DII). Note the high peak intensities relative to the intensities shown in FIG. 7.

Mass spectra obtained from DII of *V. vulnificus* not only yield 490-fold higher peak intensities, but also contained more spectral information than originally observed (FIG. 8).

A discharge electrode for DII was setup in the sample introduction chamber (FIG. 9). Continued use of the DART for DII overheated the circuitry. An external power supply was, therefore, used for the generation of corona discharges.

A small custom-made glass cylinder with two juxtaposing orifices on each side was set up within the sample introduction chamber (FIG. 9) to exclude atmospheric contaminants, and prevent oxidation of pyrolysates. The cylinder also shielded against ambient moisture, ensuring that proton transfer from water molecules (chemical ionization) would not increase spectral irreproducibility (FIG. 9).

Figure 10:
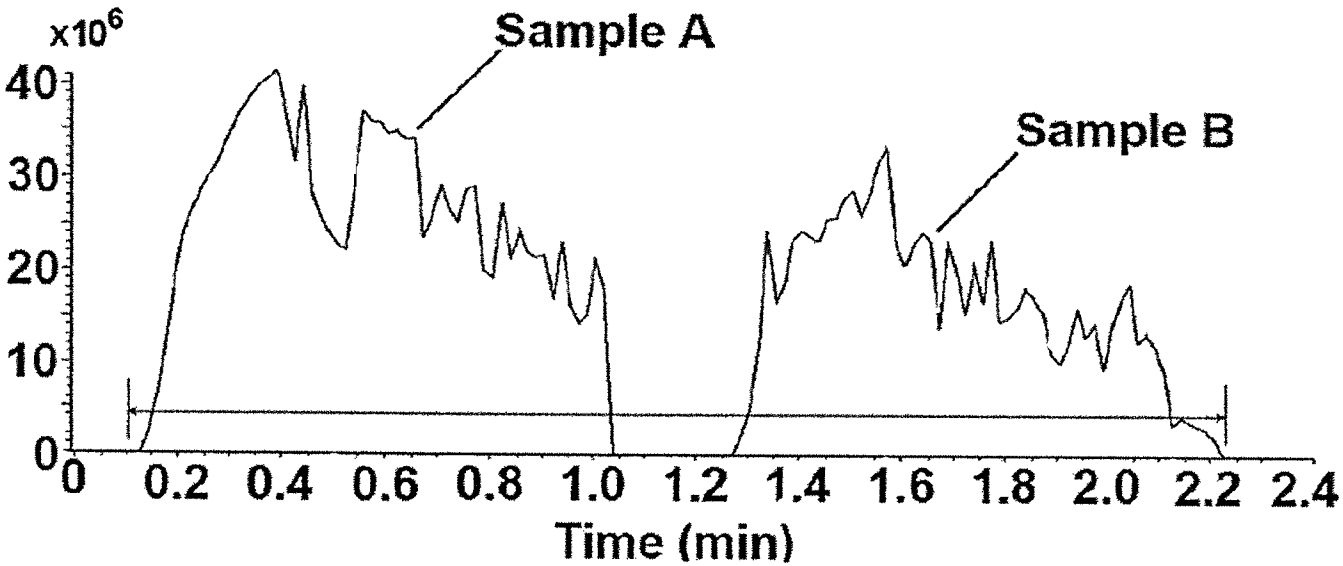
FIG. 10 is a set of total ion intensity profiles of two bacteria samples, A and B, from the same isolate of *V. vulnificus* shown in FIGS. 7 and 8.

During DII, ion intensity profile graphs—known as "pyrograms"—were obtained. Mass spectra could have been obtained from any point or interval within a pyrogram (FIG. 10).

Figure 11:
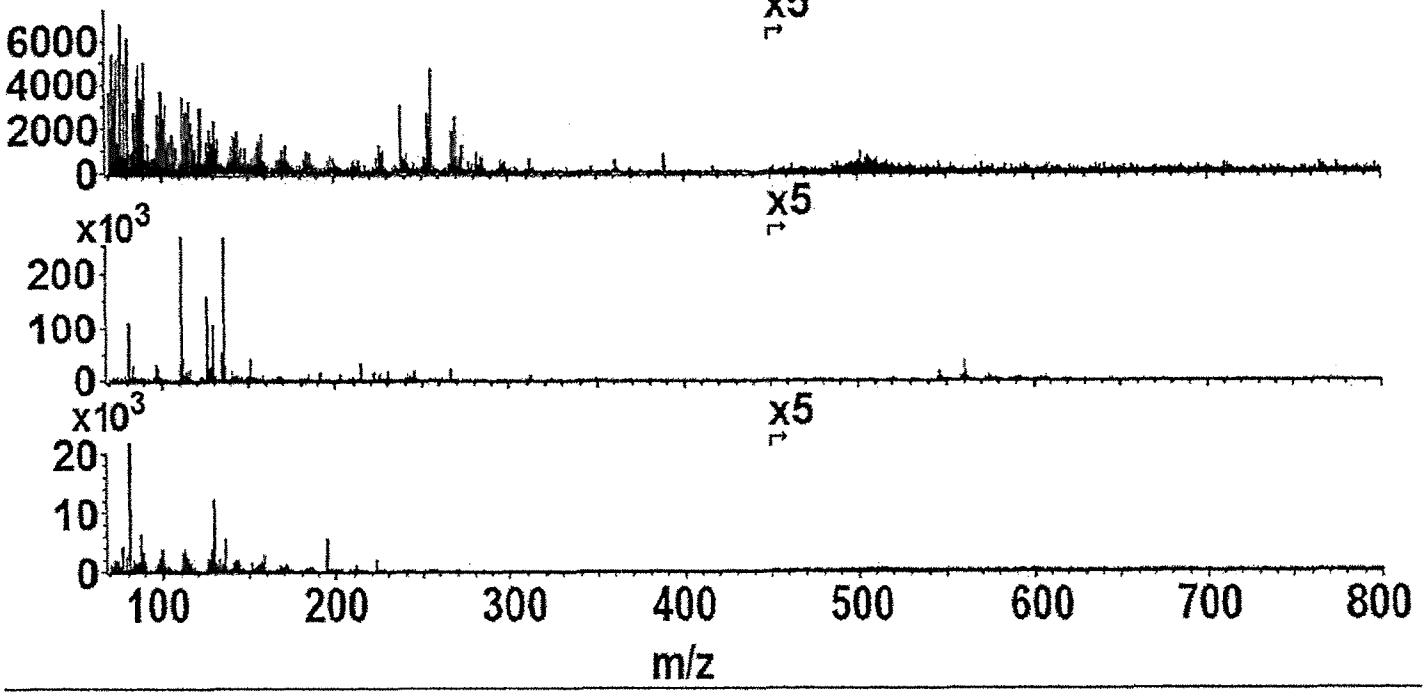
FIG. 11 is a set of spectra of the same sample acquired at different points (early, mid- and late run) in a bacterial pyrogram.

Mass spectra acquired randomly at different times during continuous DII are quite different, as evidenced in FIG. 11, and are consequently less suitable for spectral fingerprinting.

Figure 12:
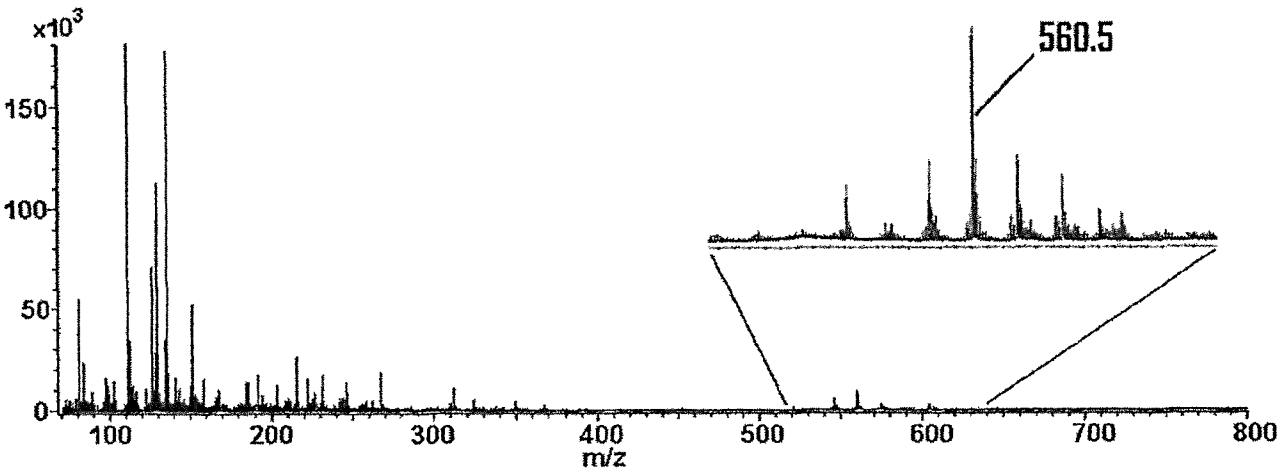
FIG. 12 is a mass spectrum from a total ion profile. Note the indicator ion at 560.5 m/z.

From FIG. 11, it is unclear which spectrum could represent the combination of biomolecules in the bacterium analyzed. The bacterial spectra acquired that change over time due to a time-temperature sensitive process. Bacterial samples are subject to heat during DII, which results in differential volatilization beginning with the more volatile components. This is reflected in changing mass spectra over time. Selecting the most informative and reproducible spectrum for each bacterium can be helpful. By integrating over the duration of a DII run, a representative mass spectrum of all components can be obtained (FIG. 12).

In this way all sample components were proportionally represented in the pattern, but the extended analysis over was contrary the rapid analysis objective. As seen in FIG. 12, a high mass ion at 560.5 m/z appeared in the global spectrum. We observed that the same ion appeared in spectra of many different bacteria. We noted also that whenever this peak maximized near the beginning of the acquisition, the whole spectrum harbored a wealth of valuable information.

Figure 13:
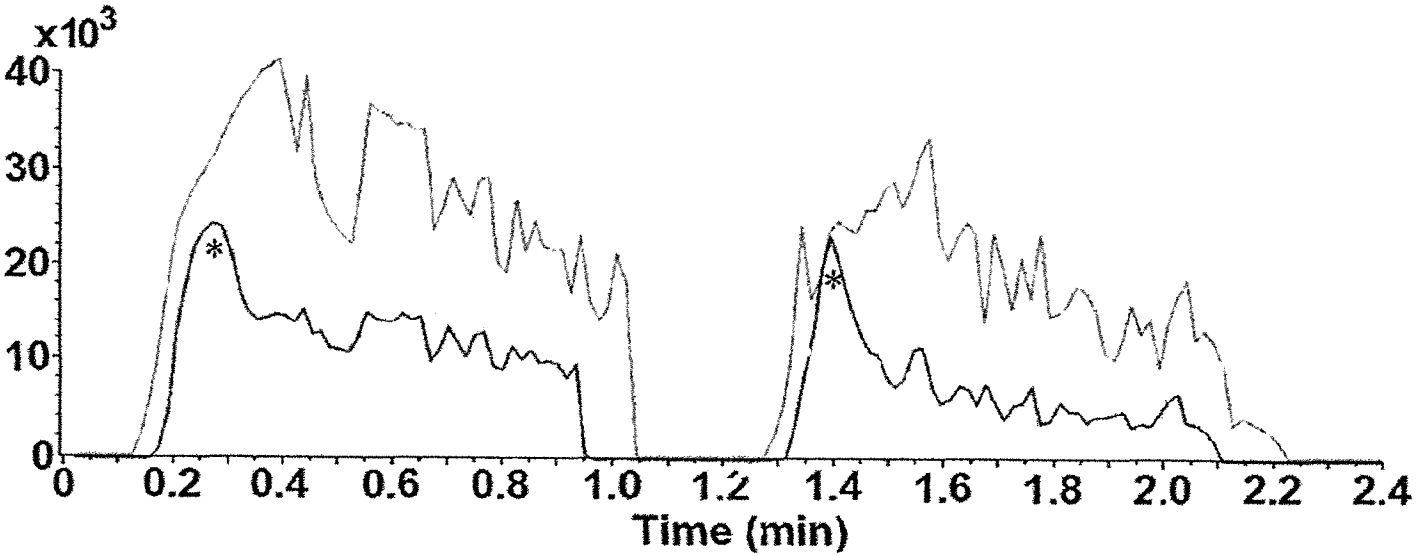
FIG. 13 is a total ion pyrogram (gray trace) and single ion pyrogram for 560.5 m/z.
Figure 14:
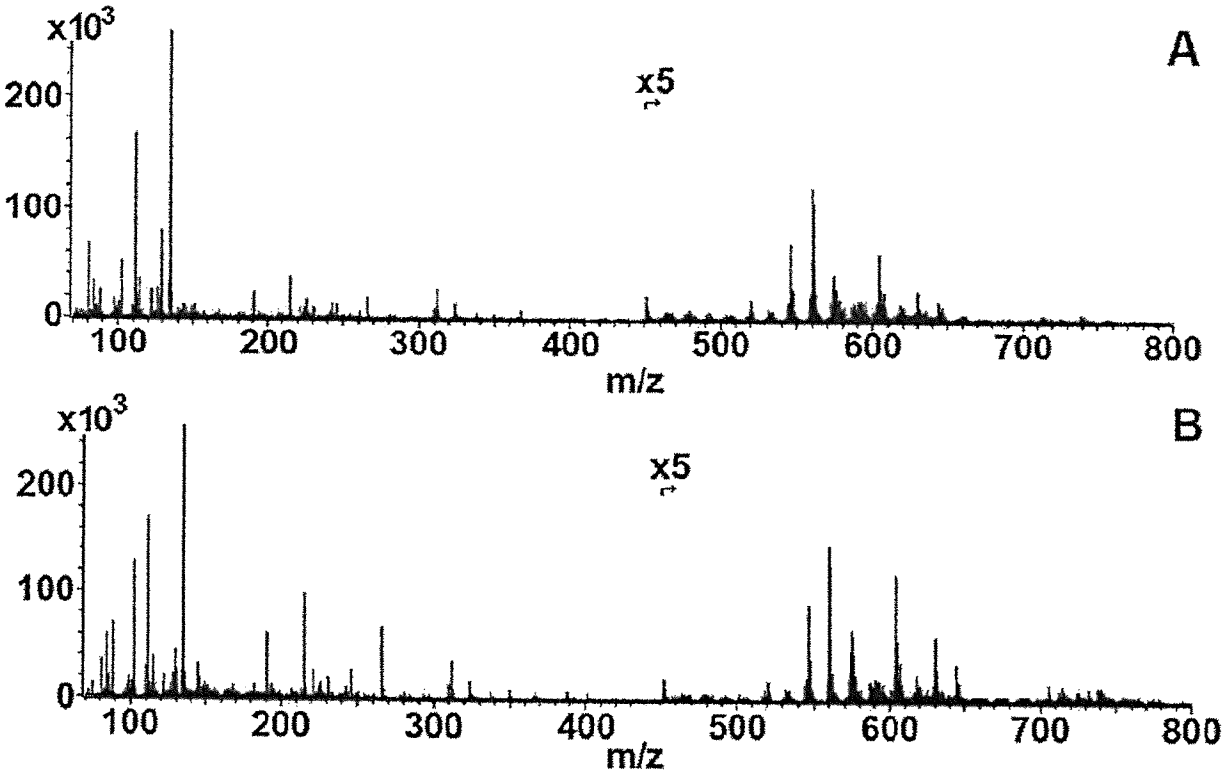
FIGS. 14A and 14B are extracted mass spectra.
Figure 15:
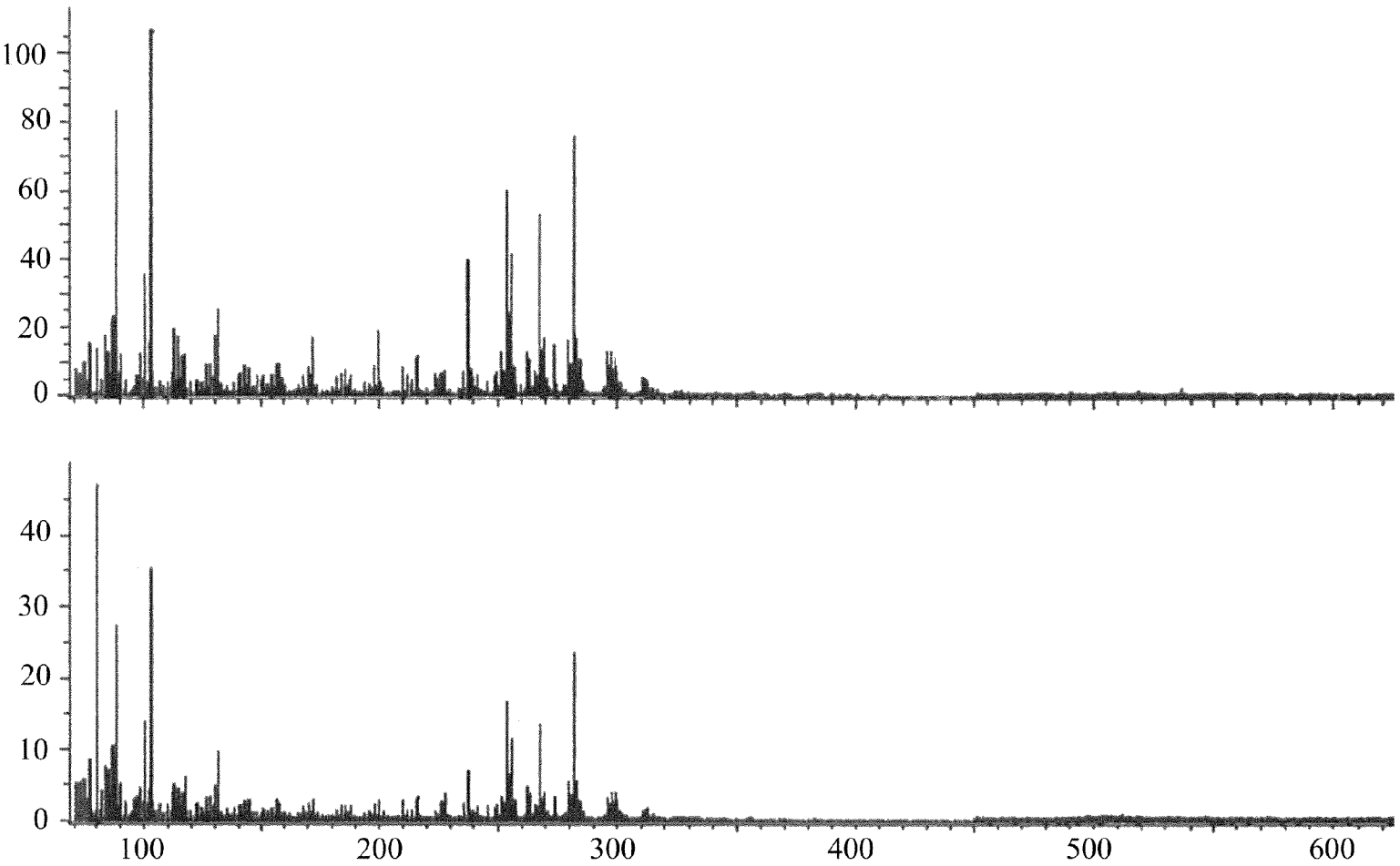
FIG. 15 is a set of mass spectra obtained from two different samples of *Salmonella enterica*. The two representative spectra exhibit striking resemblance and demonstrate the reproducibility of the disclosed integration method.
Figure 16:
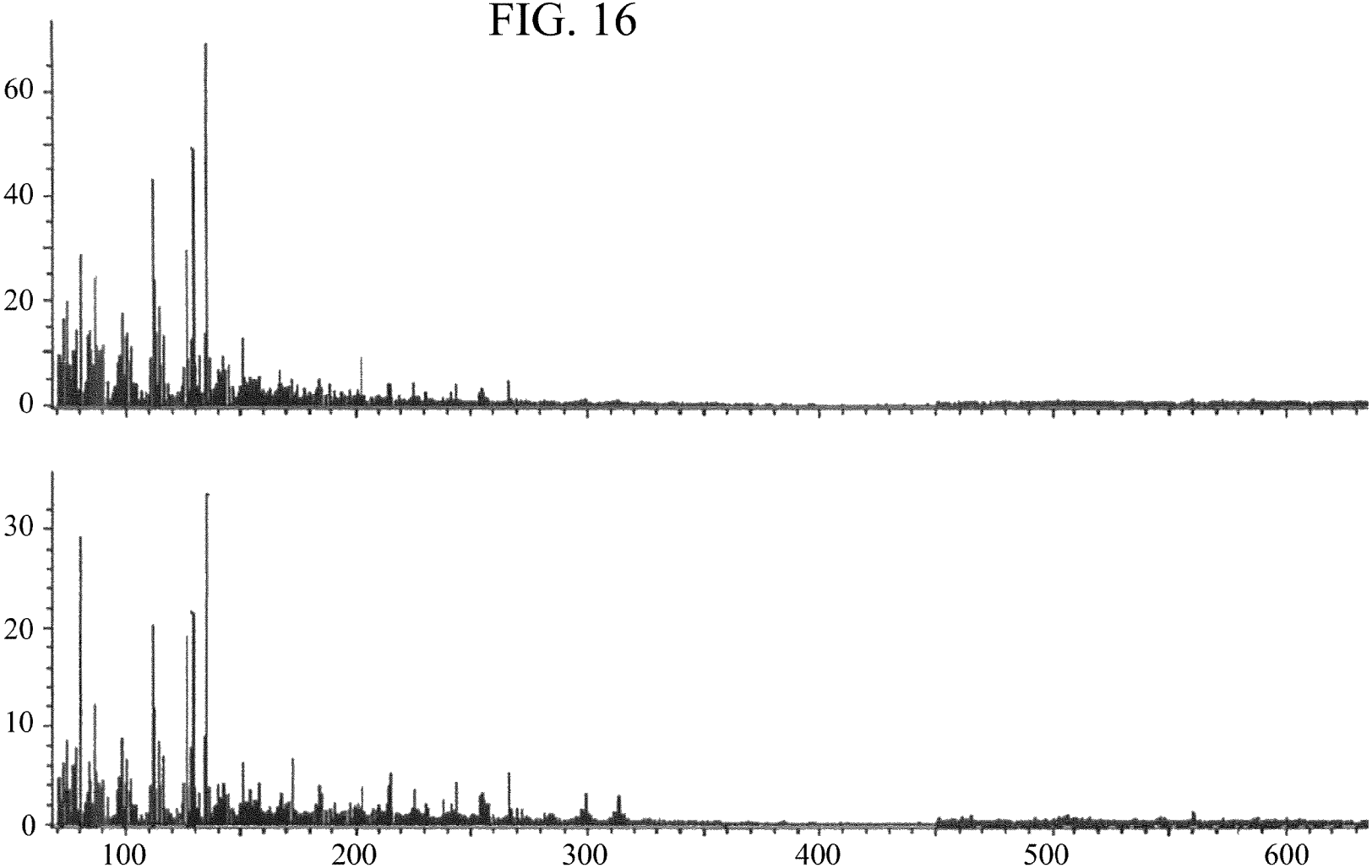
FIG. 16 is a set of mass spectra obtained from two different samples of *Salmonella* Heidelberg. Note that one can also distinguish mass spectra of *Salmonella enterica* from *Salmonella* Heidelberg, indicating that bacteria sub-types can be identified using the disclosed methods.

In FIG. 13, for two replicates from a single run, the 560.5 m/z single ion pyrogram (red and blue plots, for each replicate, respectively) and the total ion program (gray plot) are superimposed. 560.5 m/z were not present the entire time ions were being produced; the point at which the 560.5 m/z peak maximized did not correspond to the highest point of total ion intensity. However, when the 560.5 m/z reached maximum intensity, all other ions were represented and the spectra proved reproducible as shown in FIGS. 14A and 14B.

The silhouettes of mass spectra acquired in this manner turn out to be, not identical but similar. This is what one would expect for two spectra that originate from two different samples of the same bacterium. To date, 24 different types of bacteria have been successfully tested using this newly developed mass spectrum selection method. The method using 560.5 m/z as descriptor worked well for most bacteria tested. *Bacillus anthracis* and *Bacillus thuringiensis* did not contain the ion but similar consistency of pattern could be obtained using the next heaviest ion as a temperature indicator, in those cases 343.24 and 313.45 m/z, respectively. Mass spectra obtained in this manner can now be obtained in the first six seconds of DII and can be used for library building and sample identification.

The newly developed mass spectra extraction technique allowed extraction of spectra acquired from the same bacterial isolates, which can provide for a method of rapid bacterial identification and/or detection. For example, whole cell analysis of foodborne pathogens and other bacteria can be carried out rapidly and reliably. Mass spectra identification can then be corroborated using hierarchal cluster analysis (HCA, ArrayTrack™). The methodology described in this study enables rapid, specific, sensitive and reproducible pattern definition for microbiological analytes with potential uses in fields such as pathogen determination in clinical settings, quality assurance (of drugs, foods or cosmetic ingredients), continuous monitoring of air-, water-, and foodborne biowarfare agents (BWA).

In view of the many possible embodiments to which the principles of our invention may be applied, it should be recognized that illustrated embodiments are only examples of the invention and should not be considered a limitation on the scope of the invention. Rather, the scope of the invention is defined by the following claims. We therefore claim as our invention all that comes within the scope and spirit of these claims.

We claim:

1. A mass spectrometer for analyzing a sample, comprising:

a conductive sample platform which functions as a counter electrode or discharge electrode and a surface to provide the sample to be analyzed;

an ion source positioned adjacent to the sample platform and configured to ionize a gas and direct the gas toward the sample;

a bias source coupled to the conductive sample platform and the ion source and configured to establish a potential difference between the conductive sample platform and the ion source;

an ion transmission device situated to collect ions produced from the sample; and a mass analyzer coupled so as to receive ions from the ion transmission device for measuring a mass versus charge ratio of the molecule collected in the ion transmission device, thereby allowing a mass spectrum of the sample to be generated, wherein the conductive sample platform includes a recess defining a protuberance, the protuberance forming a point that is positioned toward the ion source thereby providing a point of impact for an electrical discharge between the sample platform and the ion source.

2. The mass spectrometer of claim 1, wherein the sample platform is positioned about 4 mm from the ion source.

3. The mass spectrometer of claim 1, wherein a potential difference of 1-4 kV is applied between the ion source and the sample platform.

4. The mass spectrometer of claim 1, the potential difference applied by the bias source is associated with an electrical discharge between the conductive sample platform and the ion source.

5. The mass spectrometer of claim 1, wherein the sample comprises a biological sample.

6. The mass spectrometer of claim 5, wherein the biological sample comprises microorganisms.

7. The mass spectrometer of claim 1, wherein the sample platform has low thermal mass.

8. The mass spectrometer of claim 3, wherein the sample platform is formed from a wire mesh.

9. The mass spectrometer of claim 1, wherein the sample platform comprises a recess for positioning the sample to be analyzed.

10. The mass spectrometer of claim 1, further comprising a non-conductive shield positioned between the ion source and ion transmission device for shielding the sample from atmospheric contaminants.

11. The mass spectrometer of claim 10, wherein the ion transmission device is tapered so as to have a smaller end facing the sample platform and is situated at least partially within the non-conductive shield.

12. The mass spectrometer of claim 10, wherein the atmospheric contaminants comprise atmospheric oxygen, atmospheric water vapor or a combination thereof.

13. A method for generating a mass spectrum of a sample, comprising:

positioning a sample platform comprising a sample less than about 1 cm from an ion source;

establishing an electrical discharge in a gas with an ion the ion source and directing the gas to a sample situated on a sample platform, wherein the recess in the sample platform forms a protuberance configured to protrude from the sample platform forming a point that is positioned toward the ion source thereby providing a point of impact for an electrical discharge between the sample platform and the ion source;

generating ions from the sample while applying a potential difference between the ion source and the sample platform;

transporting the generated ions to a mass analyzer; and measuring a mass to charge ratio of the generated ions with the mass analyzer so as to produce the mass spectrum.

14. The method of claim 13, wherein the gas is one or more of helium, neon, argon, krypton, xenon, or nitrogen, and the electrical discharge is configured to produce metastable atoms of the gas, and wherein the metastable atoms of the gas are directed to the sample.

15. The method of claim 13, wherein a potential difference of 1 to 4 kV is applied between the ion source and the sample platform.

16. The method of claim 14, wherein the potential difference is configured to produce a spark discharge between the ion source and the sample platform.

17. The method of claim 13, wherein the potential difference is configured to produce a corona surrounding the ion source and the sample.

18. The method of claim 13, further comprising shielding the sample from atmospheric contaminants during the ion generation.

19. The method of claim 13, wherein the sample is shielded from the atmospheric contaminants using a shield formed of non-conductive material positioned between the ion source and ion transmission device.

20. The method of claim 19, wherein the atmospheric contaminants comprise atmospheric oxygen, atmospheric water vapor or combinations thereof.

21. The method of claim 20, wherein the non-conductive material comprises glass, plastic or ceramic.

22. The method of claim 13, wherein the sample comprises a biological sample.

23. The method of claim 22, wherein the biological sample comprises microorganisms.

24. The method of claim 13, wherein the sample platform has low thermal mass.

25. The method of claim 13, wherein the sample platform comprises a wire mesh.

26. A method for generating a mass spectrum of a sample, comprising:

positioning a sample platform comprising a sample less than about 1 cm from an ion source, the sample platform comprising a recess in which a protuberance configured to receive the sample and extending from the sample platform is defined;

establishing an electrical discharge in a gas with an ion source and directing the gas to a sample situated on a sample platform, wherein the protuberance is formed by the recess of the sample platform so as to extend toward the ion source;

generating ions from the sample while applying a potential difference between the ion source and the sample platform;

transporting the generated ions to a mass analyzer; and measuring a mass to charge ratio of the generated ions with the mass analyzer so as to produce the mass spectrum.

27. The method of claim 13, wherein the gas is one or more of helium, neon, argon, krypton, xenon, or nitrogen, and the electrical discharge is configured to produce metastable atoms and ions of the gas, and wherein the metastable atoms and ions of the gas are directed to the sample.

28. The method of claim 13, further comprising applying a potential difference to an ion transmission device situated to collect ions produced from the sample.

* * * * *